US009926712B2

(12) United States Patent
Oshibe

(10) Patent No.: US 9,926,712 B2
(45) Date of Patent: Mar. 27, 2018

(54) CARRY TYPE WAVE-MAKING APPARATUS FOR SURFING AND A SURFING TRAINING EQUIPMENT WITH THE SAME

(71) Applicant: RESPONSE-ENGINEER, INC., Kobe-shi, Hyogo (JP)

(72) Inventor: Takahiro Oshibe, Kobe (JP)

(73) Assignee: RESPONCE-ENGINEER, INC., Hyogo (JP)

( * ) Notice: Subject to any disclaimer, the term of this patent is extended or adjusted under 35 U.S.C. 154(b) by 0 days.

(21) Appl. No.: 15/320,127

(22) PCT Filed: Feb. 13, 2015

(86) PCT No.: PCT/JP2015/053986
§ 371 (c)(1),
(2) Date: Dec. 19, 2016

(87) PCT Pub. No.: WO2016/129107
PCT Pub. Date: Aug. 18, 2016

(65) Prior Publication Data

US 2017/0335584 A1 Nov. 23, 2017

(51) Int. Cl.
*E04H 4/00* (2006.01)
*A63G 31/00* (2006.01)
(Continued)

(52) U.S. Cl.
CPC ..... *E04H 4/0006* (2013.01); *A63B 69/0093* (2013.01); *A63G 31/007* (2013.01); *A63B 69/125* (2013.01); *A63B 2208/12* (2013.01)

(58) Field of Classification Search
CPC combination set(s) only.
See application file for complete search history.

(56) References Cited

U.S. PATENT DOCUMENTS 3,557,559 A * 1/1971 Barr ..... E04H 4/0006 4/491
3,973,405 A * 8/1976 Duport ..... E02B 1/02 4/491
(Continued)

FOREIGN PATENT DOCUMENTS

JP 53-63051 A 6/1978
JP 01-163370 A 6/1989
(Continued)

OTHER PUBLICATIONS

International Search Report and Written Opinion, International Patent Application No. PCT/JP2015/053986, dated Apr. 14, 2015, with English translation of Search Report (9 pages).
(Continued)

*Primary Examiner* — Kyle Armstrong
(74) *Attorney, Agent, or Firm* — Hamre, Schumann, Mueller & Larson, P.C.

(57) ABSTRACT

[Problem to be solved]
To provide a wave making apparatus for surfing that can make a so-called tubular curling wave suitable for surfing and in which a breaking portion and about to break portion are arrayed in a line.
[Solution]
The wave making apparatus comprises: a water carrying bucket 110 opened at the front, including a bottom plate and a side surface plate, and capable of holding water in a portion of an inner space thereof; a supporting structure 120 that supports the water carrying bucket 110; and a transmission apparatus 130 that moves the water carrying bucket 110 forward at a predetermined speed. The water carrying bucket 100 supported by submerging the water carrying bucket 110 under waterline of the pool such that the front of the water carrying bucket 110 faces the play area of the pool. The transmission apparatus 130 moves the water carrying bucket
(Continued)

Principle of wave making of the isolated traveling waves by carry type wave making apparatus of this invention

110 forward along a track extending forward the play area with the water carrying bucket 100 kept below the waterline. The water held in the water carrying bucket 100 is carried forward and launched, and thereby an isolation traveling wave suitable for surfing is formed.

12 Claims, 28 Drawing Sheets

(51) Int. Cl.
*A63B 69/00* (2006.01)
*A63B 69/12* (2006.01)

(56) References Cited

U.S. PATENT DOCUMENTS 4,229,969 A 10/1980 Hark
4,783,860 A * 11/1988 Funke ..... E04H 4/0006 4/491
4,792,260 A 12/1988 Sauerbier
4,806,048 A * 2/1989 Ito ..... E04H 4/0006 405/79
4,810,129 A * 3/1989 Guevel ..... E04H 4/0006 4/491
6,047,657 A 4/2000 Cox
2017/0226762 A1 * 8/2017 Fricano ..... E04H 4/0006

FOREIGN PATENT DOCUMENTS

JP 03-268772 A 11/1991
JP 05-240197 A 9/1993
JP 06-073911 A 3/1994
JP 06-78692 B 10/1994
JP 09-329525 A 12/1997
JP 11-248595 A 9/1999
JP 2002-257675 A 9/2002

OTHER PUBLICATIONS

Extended European Search Report, European Patent Application No. 15881982.1, dated Jun. 28, 2017 (8 pages).

* cited by examiner

Principle of wave making by the flap type wave making apparatus in the prior art Principle of wave making by the piston type wave making apparatus in the prior art Principle of wave making by tank chamber type wave making apparatus in the prior art The influence caused by turbulence occurred behind the movement object in water Flap type wave making apparatus disclosed in the prior art (JP11-248595)

Piston type wave making apparatus disclosed in the prior art (JP6-73911)

Air compression type wave making apparatus disclosed in the prior art (JP3-268772)

Tank chamber type wave making apparatus disclosed in the prior art (JP2002-257675)

Jet nozzle type wave making apparatus disclosed in the prior art (JP6-78692)

CARRY TYPE WAVE-MAKING APPARATUS FOR SURFING AND A SURFING TRAINING EQUIPMENT WITH THE SAME

TECHNICAL FIELD

This invention relates to a wave-making apparatus for surfing that makes waves to be used for surfing training, and a surfing training equipment including a pool in which the wave-making apparatus is installed.

This invention provides equipment for serious surfers to practice tube riding surfing techniques and for recreational surfers to enjoy the tube riding activity of surfing.

BACKGROUND ART

Surfing is a popular sport all over the world. People taking it up in earnest are increasing, not only as a marine leisure activity but also as an athletic sport in late years. However, it is necessary to visit the sea shores that have the natural environment suitable for surfing in order to enjoy surfing.

A sea shore having the natural environment suitable for surfing is a contour of a coast to face to the open ocean that the big waves easily reach and become so-called big isolated waves to travel toward the sea shore. It needs to have a shallow seafloor topography that makes the waves easy to appear a wave breaking area followed by a wave about to break area in a line in the isolated waves.

The above-mentioned isolated wave does not mean the oscillating wave repeating the up and down movement at the same point, but it means the waves with some interval between each wave and every single wave traveling forward independently.

A wave especially suitable for surfing is a wave appearing to have a tubular curly portion in its vertical cross sectional view by emerging a wave breaking area followed by a wave about to break area in a line in the isolated waves. This makes it possible for surfers to play surfing by sliding toward from the wave breaking area to the wave about to break area of these tubular curling wave portions.

The coasts where the waves are formed suitable for surfing are limited to the places where the natural conditions are satisfied. It is impossible to enjoy surfing all over the world.

Therefore, the development of the wave making apparatus for surfing to enable enjoying surfing by making artificial waves suitable for surfing at pools in the prior art has been desired.

The following types are known as the wave making apparatuses to make artificial waves in a pool in the prior art.

A so-called flap type wave making apparatus is known.

As shown in FIG. 24, this type generates waves by reciprocating swinging of a part-submerged wave-making flap board whose bottom end is supported rotatably with a hinge in the bottom of the pool as a pivot.

A so-called piston type wave making apparatus is known.

As shown in FIG. 25, this type generates waves by a reciprocating motion pushing and pulling of a part-submerged piston installed to the axis.

An air compression type wave making apparatus is known.

As shown in FIG. 26, the air compressed type wave making apparatus generates waves by fluctuating water level by pulling up and pushing down water by air vacuum and air blowing by the vacuum pump or air blower in the air storage tank facing under the water line of the pool.

Also, a tank chamber type wave making apparatus is known.

As shown in FIG. 27, the tank chamber type wave making apparatus generates waves by falling the stored water in the pool by opening the gate momentarily after when water is stored until a fixed height in the water storage tank with pumps. The gate is installed to the lower portion of the water storage tank and facing to the waterline in the pool.

Furthermore, a water jet nozzle type wave making apparatus is known.

As shown in FIG. 28, this water jet nozzle type wave making apparatus generates waves by jetting pressurized water via the nozzle.

Prior art 1: JP Tokkai-Hei11-29904

Prior art 2: JP 2001-70497

DISCLOSURE OF THE INVENTION

The Problems to be Solved

However, the various wave making apparatus mentioned in the prior art have some problems as follows from the point of view of the generated wave figure made by the apparatus being suitable for surfing or not.

Firstly, the waves formed by the flap type wave making apparatus are so-called up and down motion waves moving vertically at the same point in the pool and are not isolated traveling waves traveling forward.

Therefore, it is impossible to form so-called tubular curling waves suitable for surfing by emerging a wave breaking area followed by a wave about to break area in a line in the isolated waves. Therefore, it doesn't enable formation curling waves suitable for surfing, even if the scale of the device is enlarged to provide the larger power to water.

If the flap type wave making apparatus generates a bigger wave, the flap should be made bigger, and it is necessary to deepen the pool. The problem of the mechanism becoming complicated occurs and the power to be provided becomes large in order to move the flap against the heavy quantity of water in the pool.

Next, like the flap type, the waves formed by the piston type wave making apparatus are so-called up and down motion waves moving vertically at the same point in the pool and are not isolated traveling waves traveling forward.

Therefore, it is impossible to form so-called tubular curling waves suitable for surfing by emerging a wave breaking area followed by a wave about to break area in a line in the isolated waves. Therefore, it doesn't enable forming curling waves suitable for surfing, even if the scale of the device is enlarged to provide the larger power to water.

Next, like the flap type and piston type, the waves formed by the air compressing type wave making apparatus are so-called up and down motion waves moving vertically at the same point in the pool and are not isolated traveling waves traveling forward.

Therefore, it is impossible to form so-called tubular curling waves suitable for surfing by emerging a wave breaking area followed by a wave about to break area in a line in the isolated waves. Furthermore, it is not an energy efficient apparatus to form large waves because this would utilize a huge vacuum pump.

The tank chamber type wave making apparatus has a problem in the emitting direction of the stored water. However, the water basically to fall just below the tank chamber installed in the pool. Because of the fallen water heavy potential energy is given to the pool vertically, waves are generated as so-called up and down motion waves moving vertically at the same point in the pool and are not isolated traveling waves to travel forward.

Therefore, it is impossible to form so-called tubular curling waves suitable for surfing by emerging a wave breaking area followed by a wave about to break area in a line in the isolated waves. Furthermore, it is not an energy efficient apparatus to form large waves because this would utilize a pump apparatus to pump up water to the water tank.

Next, it is impossible to form real curling waves by the water jet nozzle type wave making apparatus. It is only to flow water on a curved surface shaped an arch and the players only slide on the flowing water along the curved surface. It is not possible to form so-called tubular curling waves suitable for surfing by emerging a wave breaking area followed by a wave about to break area in a line in the isolated waves.

It is an object of the present invention to provide a wave making apparatus for surfing which can make so-called tubular curling waves suitable for surfing by emerging a wave breaking area followed by a wave about to break area in a line in the isolated waves, which is difficult for traditional wave making apparatus to generate.

Means for Solving the Problems

In order to achieve the above-mentioned object, the present invention of a wave making apparatus for making wave for surfing travelling forward to a play area in a pool comprises; a water carrying bucket comprising a bottom plate, right side plate and left side plates whose front is opened and that can hold water in a part of an inner space while carrying water forward; a supporting structure supporting the water carrying bucket in a part-submerged state at the waterline of a pool and facing its front to a play area of a pool: a transmission apparatus to transmit the water carrying bucket forward along a track toward the play area as the water carrying bucket in the part-submerged state at the waterline of the pool and facing its front to the play area of the pool; wherein the carried water carried by the water carrying bucket transmitted by the transmission apparatus is launched forward to generate a wave.

According to the above configuration, water held and carried by the water carrying bucket is pushed long way along with the moving of the water carrying bucket and is launched forward. The kinetic energy of the launched water is transmitted forward as a traveling wave, and the wave making apparatus can make an isolated traveling wave.

The wave making apparatus scoops water relatively near the upper portion of the pool with the water carrying bucket and carries the held water forward with impetus. This type of the water making apparatus in this invention is defined as a "carry type wave making apparatus".

According to the above-mentioned wave making apparatus, the side surface of the water carrying bucket is shut by the right side panel and the left side panel, so turbulence does not occur at the boundary of the side surfaces of the water carrying bucket. It enables forming the high quality isolated travelling waves with little disorder. In addition, most of the kinetic energy of the carried water can be converted to the kinetic energy of the travelling waves since most of the carried water is launched forward as the travelling waves only, with little kinetic energy idly expended in downward or lateral directions in the pool. The energy efficiency becomes high.

The structure of the water carrying bucket has some types as follows.

One type is that there are plural water carrying buckets and these are arrayed and supported in a line in the width direction facing to the play area. This type enables forming one big traveling wave when the plural water carrying buckets are arrayed in a line and move forward in synchronization. In addition, if there is no gap between the water carrying buckets, the turbulence is restrained. It is enables forming the high quality isolated traveling waves with little disorder.

Another type is that there is a single water carrying bucket and its width corresponds to the width of the traveling waves to be generated and there is one or plural vertical partition plate oriented in the back and forth direction inside of the water carrying bucket. This enables restraining the generation and the propagation of the lateral turbulence because there is a partition plates installed with appropriate distance. It enables forming the high quality isolated traveling waves with little disorder.

Next, the transmission apparatus in the carry type wave making apparatus of this invention is mentioned as below.

One transmission apparatus type is the cable type transmission apparatus comprising a power unit; a cable moved by the power of the power unit; and a connection part for connecting the water carrying bucket and the cable for transmitting the water carrying bucket according to the cable motion.

In this case, the cable does not need to pass through the water in the pool. The apparatus configuration can be simple and it enables transmitting the power of the cable to the water carrying bucket efficiently because the cable does not experience water resistance.

It is possible to provide various configurations for the cable arrangements.

For example, the power unit is installed to the back portion of the water carrying bucket in an initially set position; and there is a turning pulley for turning the cable from forward to back; wherein the cable is wired in a circuit from the power unit—the connection part—the turning pulley and back to the power unit. According to this configuration, the water carrying bucket can be operated forward and back repeatedly by the power unit.

As another example, the power unit is installed to the back portion of the water carrying bucket in an initially set position; and there is a turning pulley for turning the cable from forward to back; wherein the cable is wired in a circuit from the power unit—the turning pulley—the connection part and back to the power unit. According to this configuration, the water carrying bucket can be operated going forward and going back repeatedly by the power unit.

In addition, it is possible to employ plural systems of the transmission apparatuses per one water carrying bucket and there are plural connection parts corresponding to plural systems of the transmission apparatuses. The water carrying bucket is operated according to the cables of the plural systems of the transmission apparatuses.

For example, there can be the right system transmission apparatus and the left system transmission apparatus for one water carrying bucket, and there can be the right connection part and the left connection part, and the water carrying bucket is operated according to the right cable and the left cable of transmission apparatuses. The water carrying bucket can be carried by the connection parts and cables installed equally on both sides of the container. High quality traveling waves moving to the play area can be made because the posture of the water carrying bucket become stable without fluctuating horizontally.

For example, if the upper connection part and the lower connection part are installed, the water carrying bucket is operated according to the motion via the upper connection part and the motion via the lower connection part. The high quality traveling wave moving to the play area can be made because the posture of the water carrying bucket become stable without fluctuating vertically.

Another transmission apparatus type is the rail type transmission apparatus. In this type, the transmission apparatus can comprise a guide rail installed along the track for the water carrying bucket; and a guide wheel running on the guide rail. The guide wheel is installed on the water carrying bucket. The transmission apparatus may comprise a drive unit installed between the guide rail and the water carrying bucket instead of the guide wheel. The drive unit provides running power to the water carrying bucket. However, the apparatus size of the rail type transmission apparatus becomes larger than that of the cable type transmission apparatus. Therefore, the guide rail should be installed at the poolside area.

Next, the contribution of the partition side wall in the pool along the whole range where the water carrying bucket runs is described below.

If the width of the water carrying bucket is substantially equal with the entire width of the pool, there is a poolside wall along the motion range of the water carrying bucket. However, it is not always the case that the water carrying bucket covers the entire width of the pool. In this case, the poolside wall is not located near the water carrying bucket, and there is only the side partition panel at the side of water carrying bucket. Therefore, the partition side wall installed in the pool along the outline of the whole running range of the water carrying bucket can contribute to restraining the turbulence caused by the friction between the water and the water carrying bucket.

Next, a surfing training equipment of this invention is described below.

The surfing training equipment comprises the wave making apparatus mentioned above and a pool. The bottom structure of pool comprises a flat base portion whose range extends from the water carrying bucket moving range to the beginning of a play area and an ascending slope portion whose range extends from the end of the flat base portion through the play area. The ascending slope portion has a skew to the water carrying bucket running direction.

Physically, the speed becomes slower as the depth becomes shallower in the ascending slope section next to the flat portion. Therefore, when passing through the pool at the ascending slope portion, the difference in speed between the front edge of the wave and the following back portion grows. Finally, the back portion of the wave get ahead of and ride on the front edge of the wave, and a so-called tubular curling wave is formed, and the front edge starts to break downward in front of the curling wave. If the ascending slope portion is a triangle shape whose vertex faces to the water carrying bucket running direction, the wave speed slows first from the position corresponding to the vertex position and the wave speed starts to slow near the vertex position in order. The triangle shape curly traveling wave is formed. The front edge breaking curly portion is formed from the portion and the front edge breaking curly portion is shift to the outer side in order. The tubular curling wave suitable for the surfing is formed, in which breaking area followed by a wave about to break area in a line in the isolated waves.

Effect of the Invention

According to the carry type wave making apparatus for surfing of this invention, water near the waterline is held and carried by the water carrying bucket long way and is launched forward. The kinetic energy of the launched water is transmitted forward as an isolated traveling wave.

According to the surfing training equipment of this invention, if the ascending slope portion is installed to the beginning position of the play area, the traveling wave slows during passing through the slope area. The tubular curling wave suitable for the surfing is formed, in which breaking area followed by a wave about to break area in a line in the isolated waves.

BRIEF DESCRIPTION OF THE DRAWINGS

FIG. 1 (*b*) is a schematic view showing the principles of wave making by a carry type wave making apparatus for surfing of this invention (plan view).

FIG. 2 (*b*) is a schematic view showing the principles of wave making by a flap type wave making apparatus in the prior art (plan view).

FIG. 3 (*b*) is a schematic view showing the principles of wave making by a piston type wave making apparatus in the prior art (plan view).

FIG. 4 (*b*) is a schematic view showing the principles of wave making by an air compression type wave making apparatus in the prior art (plan view).

FIG. 5 (*b*) is a schematic view showing the principles of wave making by a tank chamber type wave making apparatus in the prior art (plan view).

FIG. 6 (*b*) is a schematic view showing the influence caused by turbulence occurring behind the movement object in water (plan view).

FIG. 7 (*b*) is a schematic view of the configuration of the wave making apparatus for surfing of this invention relating to the embodiment 1 (side view).

FIG. 9 (*b*) is the case which has singular of the water carrying bucket 110.

FIG. 10 (*b*) shows an example of cable type transmission apparatus 130*a* (side view).

FIG. 11 (*b*) is a schematic view showing the moving of the water carrying bucket 110 forward by the cable type transmission apparatus 130*a* (side view).

FIG. 12 (*b*) is a schematic view showing the moving of the water carrying bucket 110 backward by the cable type transmission apparatus 130*a* (side view).

FIG. 13 (*b*) shows an example of cable type Transmission apparatus 130*b* (side view).

FIG. 14 (*b*) is a schematic view showing the moving forward of the water carrying bucket 110 by the cable type transmission apparatus 130*b* (side view).

FIG. 15 (*b*) is a schematic view showing the moving backward of the water carrying bucket 110 by the cable type transmission apparatus 130*b* (side view).

FIG. 16 (*b*) is a schematic view showing the guide rail 135 employed in the water carrying bucket 110 (2 guide rail, 2 pulleys type).

FIG. 16 (*c*) is a schematic view showing the guide rail 135 employed in the water carrying bucket 110 (2 guide rail+side rail, 2 pulleys type).

FIG. 17 (*b*) shows an example of the motor drive unit type transmission apparatus 130*c* (side view).

FIG. 18 (*b*) is a schematic view showing the moving forward of the water carrying bucket by the drive unit 138 on the guide rail 135 in the normal rotation (side view).

FIG. 19 (*b*) is a schematic view showing the moving backward of the water carrying bucket by the drive unit 138 on the guide rail 135 in the reverse rotation (side view).

DETAILED DESCRIPTION OF THE PREFERRED EMBODIMENT

Some embodiments of a wave making apparatus and training equipment for surfing according to the present invention are described below with reference to the relevant drawing. Needless to add, the claims of the present invention include but are not limited to the application, configuration, or quantity shown in the following embodiments.

Firstly, the principles of wave making by the carry type wave making apparatus of this invention is described, and secondly, the example of the wave making apparatus is described.

Figure 1:
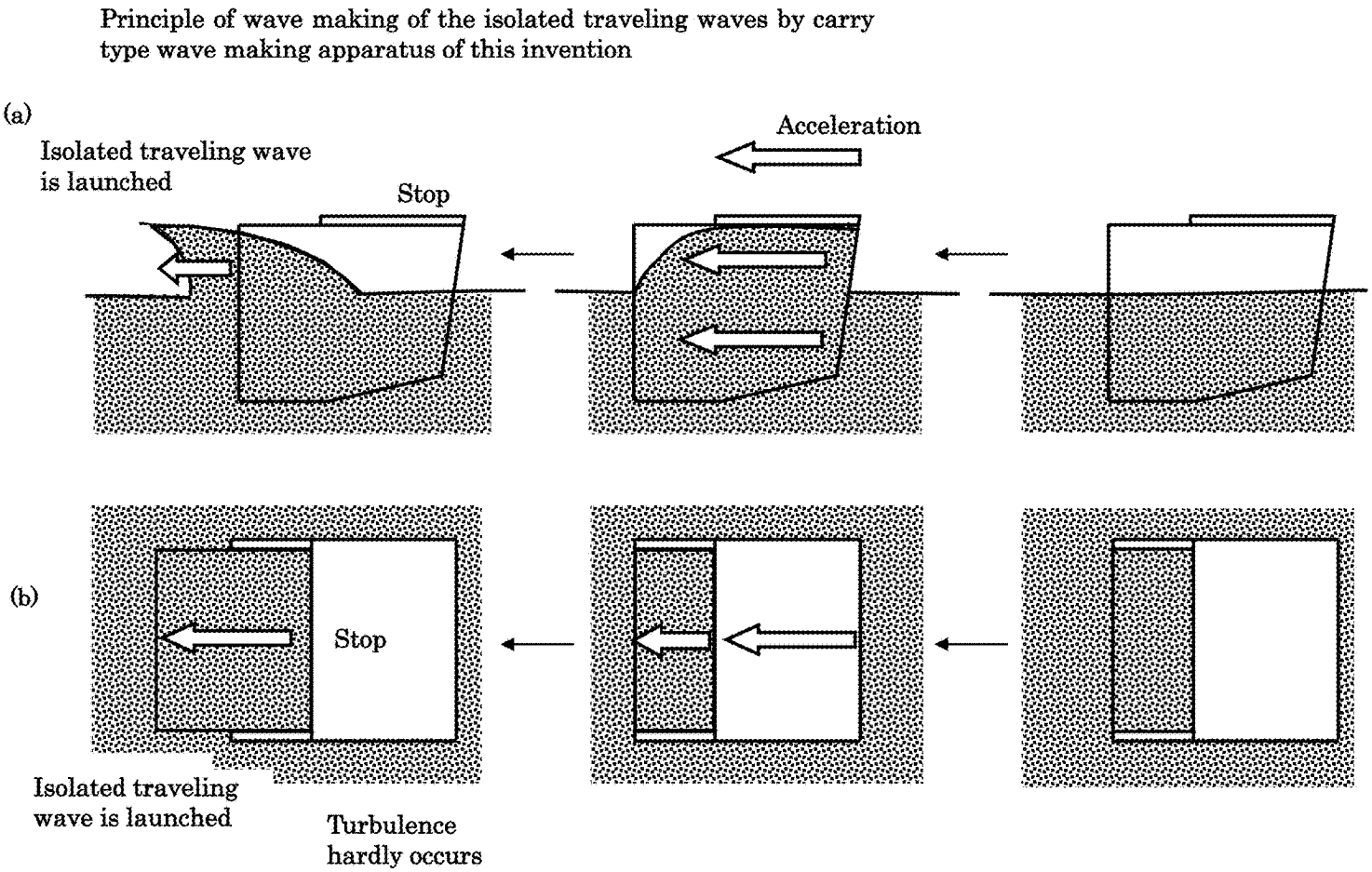
FIG. 1 (*a*) is a schematic view showing the principles of wave making by a carry type wave making apparatus for surfing of this invention (side view).

FIG. 1 is a schematic view showing the principles of wave making by a carry type wave making apparatus for surfing of this invention. In order to compare with the carry type present wave making method of the invention, the prior art method such as the flap type wave making method, the piston type wave making method and the tank chamber type wave making method are described.

In each drawing, the drawing (a) shows the vertical cross-sectional view showing the motion in the water, and the drawing (b) shows the plane view. In each drawing, the right hand drawing shows the initial state of the water carrying bucket 110, the center drawing shows the accelerating state of the water carrying bucket 110, and the left hand drawing shows the stop state of the water carrying bucket 110.

As shown in FIG. 1, the carry type wave making apparatus 100 carries water near the waterline by scooping the water carrying bucket a long way and launching it forward. The kinetic energy of the thrown water is transmitted forward as an isolated traveling wave.

The wave especially suitable for the surfing is the so-called tubular curling waves by emerging a wave breaking area followed by a wave about to break area in a line in the isolated traveling waves. This tubular curling wave is formed by slowing the speed of the isolated traveling wave, so the basic technique is forming the isolated traveling wave in order to form the tubular curling wave. By applying the principles of the wave making by a carry type wave making apparatus for surfing of this invention, the isolated traveling wave suitable for surfing is formed, and the player can enjoy surfing by sliding from the wave breaking area to the wave about to break area.

The quantity of the carried water is almost equal to the quantity of the launched water turned to be an isolated traveling wave. Therefore, most of the kinetic energy of the carried water can be converted to the kinetic energy of the travelling waves. Other kinetic energy idly expended to downward or lateral direction water in the pool can be restrained, and the energy efficiency becomes high.

The principles of wave making employed in the prior wave making methods are described for comparing the carry type wave making method.

Figure 2:
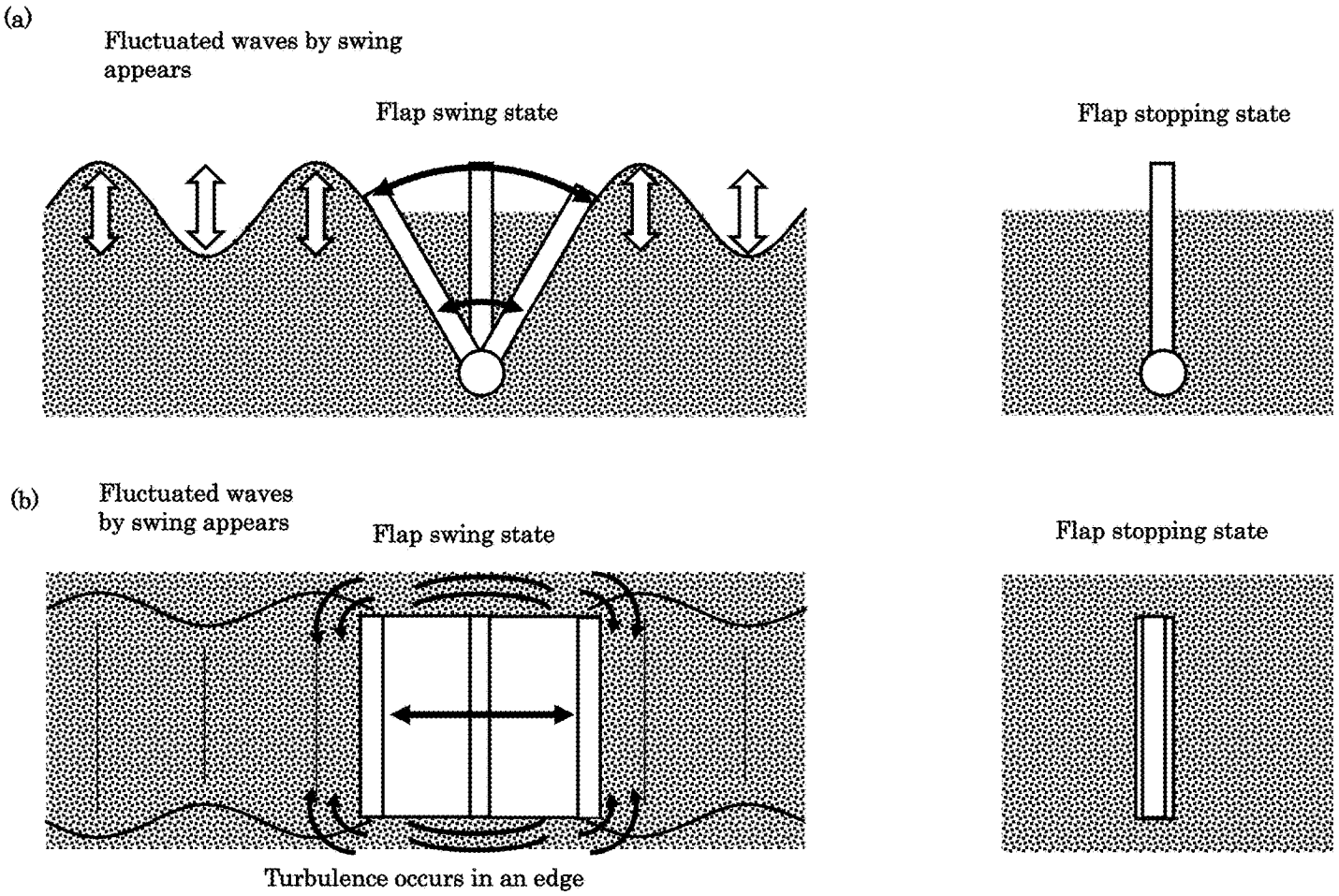
FIG. 2 (*a*) is a schematic view showing the principles of wave making by a flap type wave making apparatus in the prior art (side view).

A so-called flap type wave making method in the prior art is shown as FIG. 2. As shown in FIG. 2, this type generates waves by reciprocating swaying of a part-submerged state wave-making flap board whose bottom end is supported rotatably with a hinge at the bottom of the pool as a pivot. The kinetic energy is dispersed to the entire pool. In addition, the wave becomes an up and down fluctuating wave, and the wave does not become an isolated traveling wave.

Figure 3:
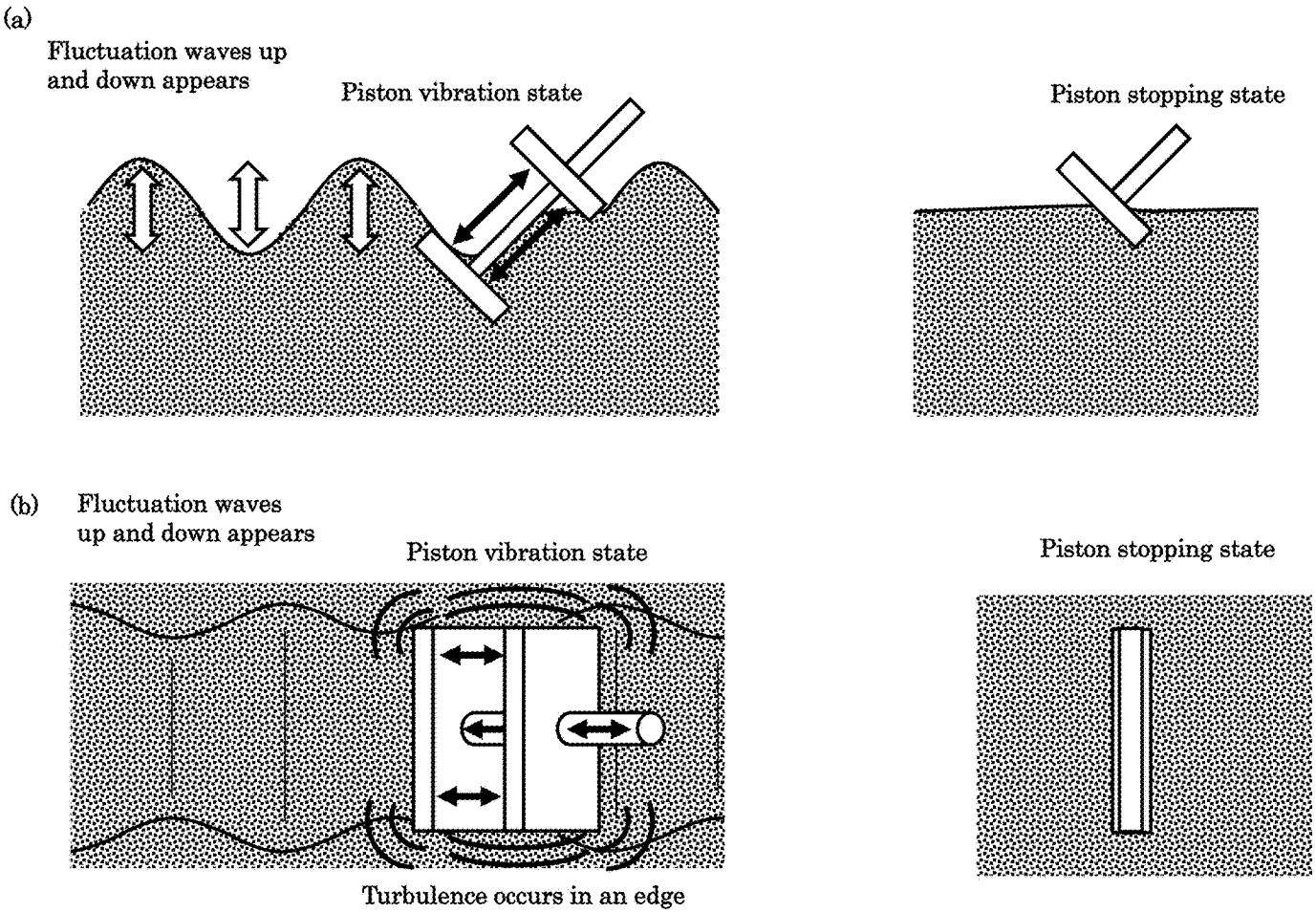
FIG. 3 (*a*) is a schematic view showing the principles of wave making by a piston type wave making apparatus in the prior art (side view).

A so-called piston type wave making method in the prior art is shown as FIG. 3. As shown in FIG. 3, this type generates waves by a reciprocating motion to push and pull of a part-submerged state piston installed to the axis. The vibration source is located in the certain position of the water pool. The kinetic energy is dispersed to the entire pool. In addition, the wave becomes up and down fluctuating wave, the wave does not become an isolated traveling wave.

Figure 4:
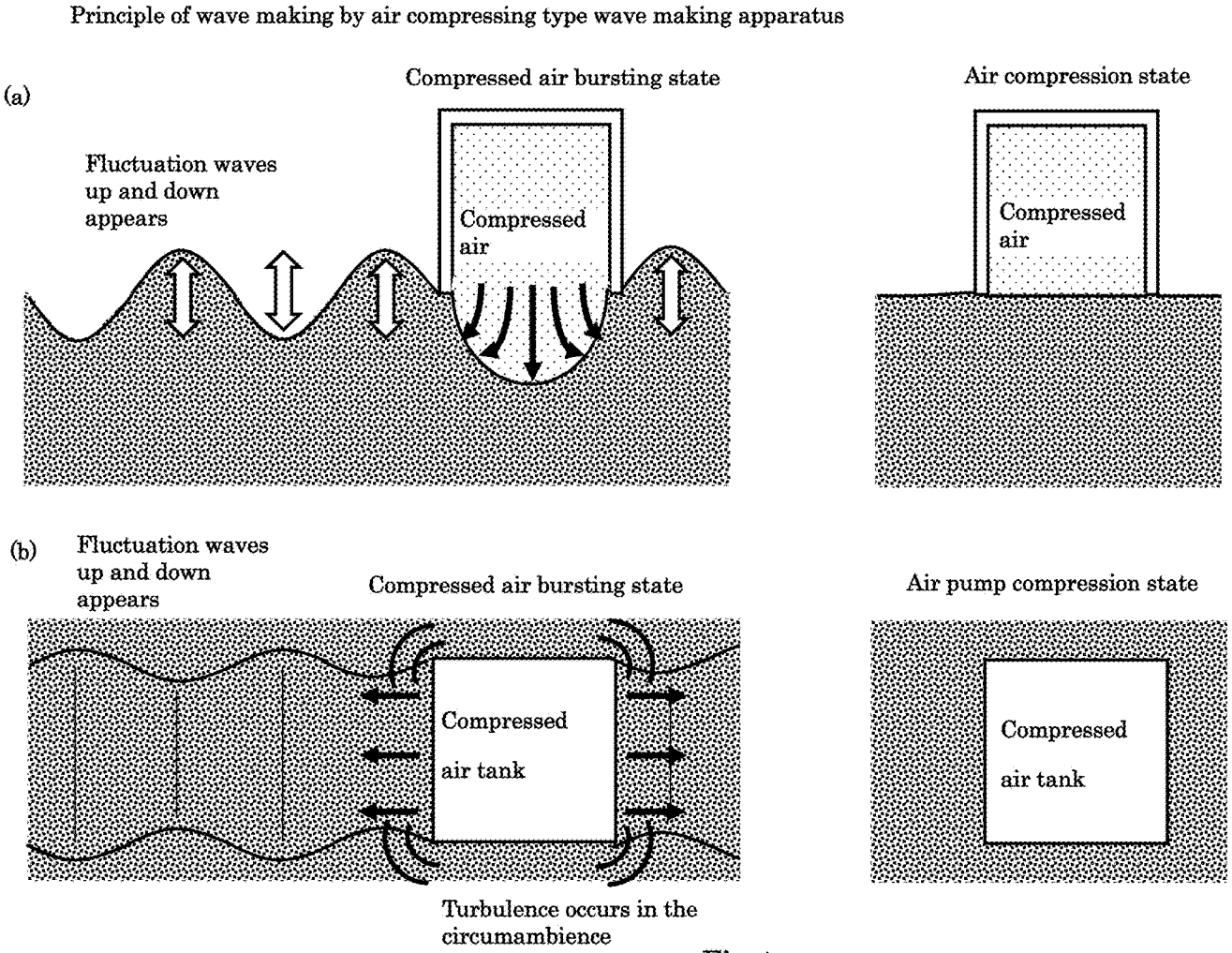
FIG. 4 (*a*) is a schematic view showing the principles of wave making by an air compression type wave making apparatus in the prior art (side view).

An air compression type wave making method in the prior art is shown as FIG. 4. As shown in FIG. 4, the air compressed type wave making method generates waves by fluctuating water level by pulling up and pushing down water by air vacuum and air blowing by the vacuum pump or air blower in the air storage tank facing under the water line of the pool. The vibration source is located in the certain position of the water pool. The kinetic energy is dispersed to the entire pool. In addition, the wave becomes an up and down fluctuating wave, the wave does not become an isolated traveling wave.

Figure 5:
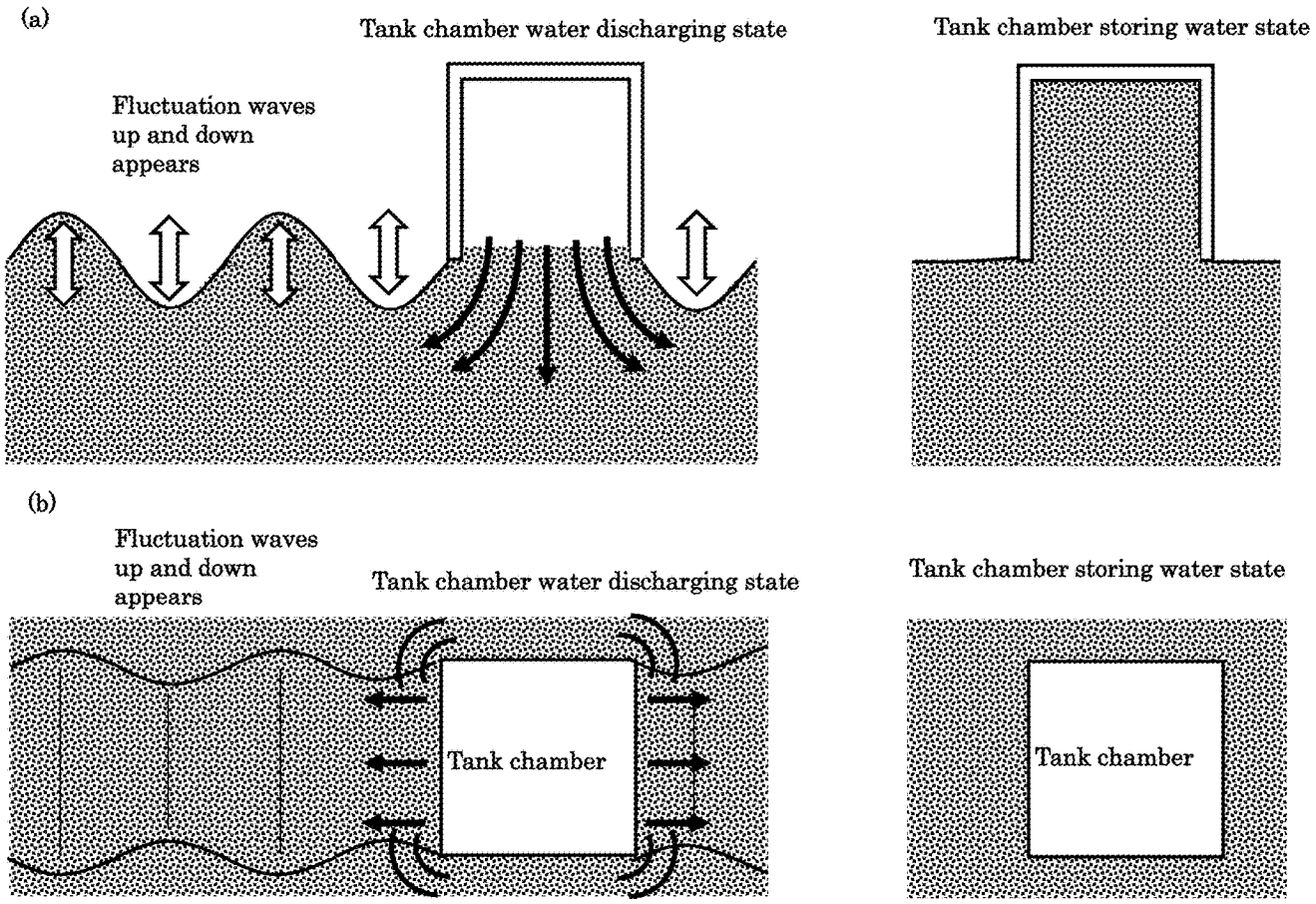
FIG. 5 (*a*) is a schematic view showing the principles of wave making by a tank chamber type wave making apparatus in the prior art (side view).

A tank chamber type wave making method in the prior art is shown as FIG. 5. As shown in FIG. 5, the tank chamber type wave making method generates waves by dropping the stored water in the pool by opening the gate momentarily after water is stored until a fixed height in the water storage tank with pumps. The potential energy of water is converted to the kinetic energy, which turns to fluctuating energy of the water. The kinetic energy is dispersed to the entire pool. In addition, the wave becomes an up and down fluctuating wave, and the wave does not become an isolated traveling wave.

By comparing the principles shown in FIG. 1 to FIG. 5, it would be understood that the carry type wave making apparatus of this invention is an advantageous system in forming isolated travelling waves suitable for surfing. Water launched forward becomes the isolated travelling waves easier according to the moving distance of the water carrying bucket 110, and its moving distance can be designed according to the amount of the water caught in the water carrying bucket 110 and the size of the play area.

Hereinafter, the influence of turbulence is described.

Figure 6:
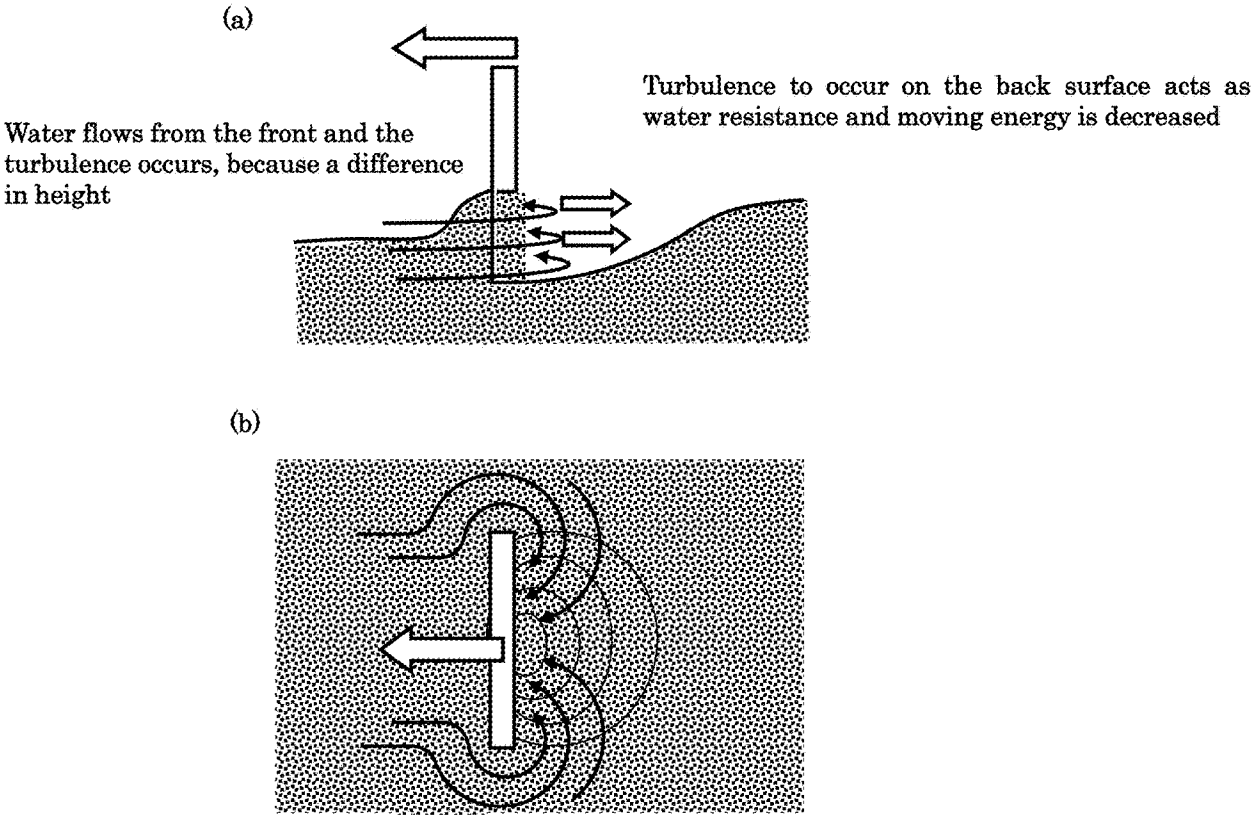
FIG. 6 (*a*) is a schematic view showing the influence caused by turbulence occurring behind the movement object in water (side view).

The influence of the turbulence cannot be ignored and it can be a big factor to deform the outline shapes of the traveling waves. FIG. 6 is a schematic view showing the influence caused by turbulence occurring behind the movement object in water. As shown in FIG. 6, if the object moving at high speed in water its facing area is large such as board body, while the water surface in front of the moving object is pushed and swelled upward to ascend the water pressure, the water surface behind the moving object is pulled and hollowed downward to descend the water pressure. The difference of the water pressure between the front surface and the rear surface hinders the moving of the object. In addition, the water flows into the hollowed water surface behind the moving object from the swelled water surface in front of the moving object and from the side of the moving object. The flow-in water contacts to the rear surface of the moving object. This flow-in water becomes water resistance because the moving object should move forward against the flow-in water. As shown above, the object having the large area such as a board shape object requires large energy when moving in high speed in water.

The turbulence disturbs the flow and deteriorates the wave suitable for surfing, which requires continuity of the front edge peak approximately in a line but slightly delayed in the lateral direction sequentially. Therefore, the turbulence disturbs the forming of the tubular curling wave in which a wave breaking area followed by a wave about to break area in a line.

The turbulence should be restrained.

As shown in the plan view of FIG. 1 (*b*), the carry type wave making apparatus of the present invention can restrain the turbulence in the boundary surface of the side plate and the outer water because the water is cut by the front edge of the side plate installed to the side surface of the water carrying bucket 110. The carry type wave making apparatus of the present invention can form the high quality isolated traveling wave with little turbulence.

As shown in FIG. 2 (*b*), the flap type wave making apparatus in the prior art generates rapid turbulence around the edge of the flap by a reciprocating swing of a part-submerged state wave-making flap board, and the generated turbulence is transmitted in the outer direction. This turbulence is one of the deformation causes for deteriorating the wave shape.

As shown in FIG. 3 (*b*), the piston type wave making apparatus in the prior art generates rapid turbulence around the edge of the piston by reciprocating fluctuation of a part-submerged state, and the generated turbulence is transmitted in outer direction. This turbulence is one of the deformation causes for deteriorating the wave shape.

As shown in FIG. 4 (*b*), the air compression type wave making apparatus in the prior art generates various turbulences at the same time by converting the air kinetic energy to the water fluctuation energy by bursting air to the pool waterline with the air compression tank. The generated turbulence is transmitted to outer direction. This turbulence is one of the deformation causes for deteriorating the wave shape.

As shown in FIG. 5 (*b*), the tank chamber type wave making apparatus in the prior art generates various turbulences at the same time by converting the water potential energy to the water fluctuation energy by dropping the stored water to the pool waterline under the water tank. The generated turbulence is transmitted in the outer direction. This turbulence is one of the deformation causes for deteriorating the wave shape.

As shown above, the advantages of the carry type wave making apparatus of the present invention can be understood from the view point of the turbulence.

Hereinafter, the examples of the carry type wave making apparatus of the present invention are described.

Embodiment 1

The carry type wave making apparatus and the training equipment for surfing of the present invention is described.

Figure 7:
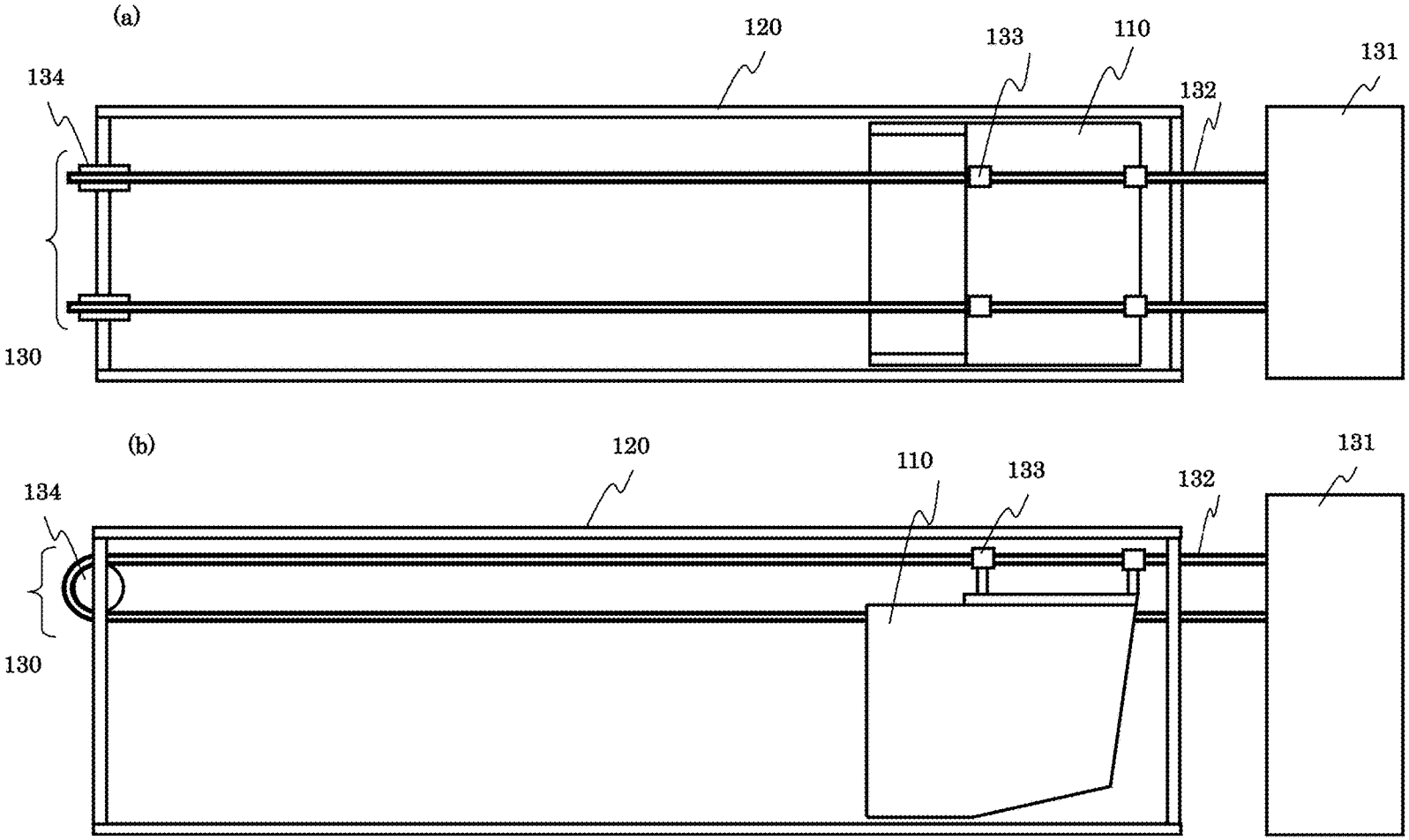
FIG. 7 (*a*) is a schematic view of the configuration of the wave making apparatus for surfing of this invention relating to the embodiment 1 (plan view).

FIG. 7 is a schematic view of the configuration of the wave making apparatus for surfing of this invention relating to the embodiment 1.

FIG. 7 (*a*) shows the plane view and FIG. 7 (*b*) shows the side view.

It is preferable to provide the walls and columns structure for reinforcement on the upper portion, the bottom portion and side portion of the supporting structure body 120 in order to enhance the mechanical structural strength in the practical actual apparatus. Those walls and columns structure for reinforcement are omitted in the drawing to show the inner structure clearly.

As shown in FIG. 7, the carry type wave making apparatus for surfing 100 of the present invention comprises a water carrying bucket 110, a supporting structure body 120 and a transmission apparatus 130. FIG. 7 shows the basic structure including one set of the water carrying bucket 110, the supporting structure body 120 and the transmission apparatus 130. Plural sets of the basic structure shown in FIG. 7 in the width direction can be used as mentioned below.

The water carrying bucket 110 enables catching and holding water in a part of the inner space. The water carrying bucket 110 has container shape comprising a bottom plate, right side plate and left side plates which front is opened.

Figure 8:
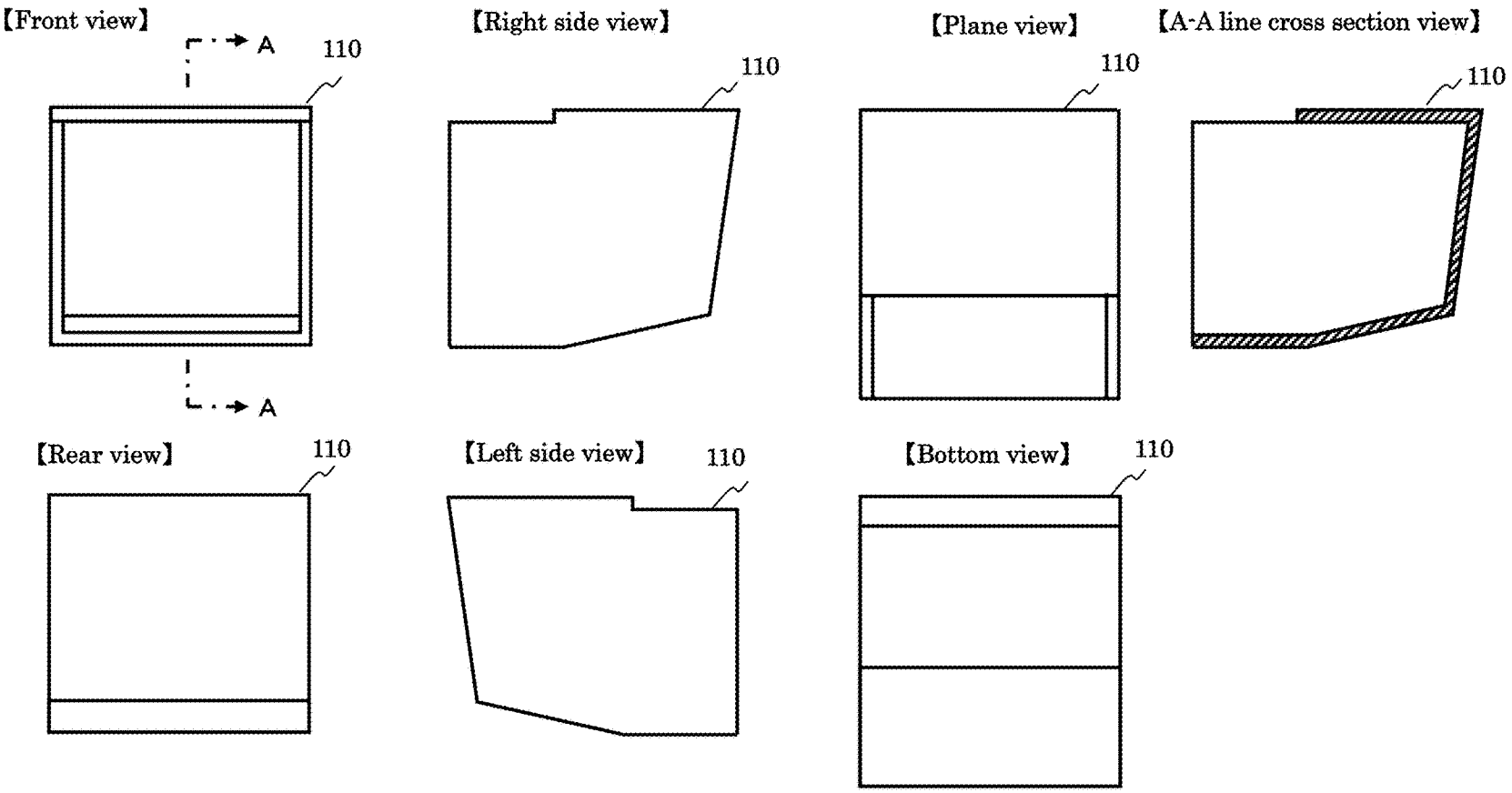
FIG. 8 shows the example of the configuration of the water carrying bucket 110.

FIG. 8 shows the example of the configuration of the water carrying bucket 110. The bottom surface has an ascending slope toward the front, and the back surface has an inclination too in this example shown in FIG. 8. Water enters into the inner space by submerging the container shape water carrying bucket 110. When the water carrying bucket 110 moves forward, the water carrying bucket 110 can hold and carry water ahead while holding water inside of the inner space.

The width of the water carrying bucket 110 should be determined corresponding to the required width of the waves for the play area. The waves generated by this carry type wave making apparatus 100 of this invention are isolated travelling waves. Therefore, the width of the waves is not widened and kept the same width during the traveling forward. Therefore, it is necessary to determine the number and width of the water carrying bucket 110 by considering the width of the waves launched to the play area. The total sum of the width of all water carrying bucket 110 should be designed for the width of a wave launched to the play area.

Some examples of the number and the width of water carrying bucket 110 are shown as below.

Figure 9:
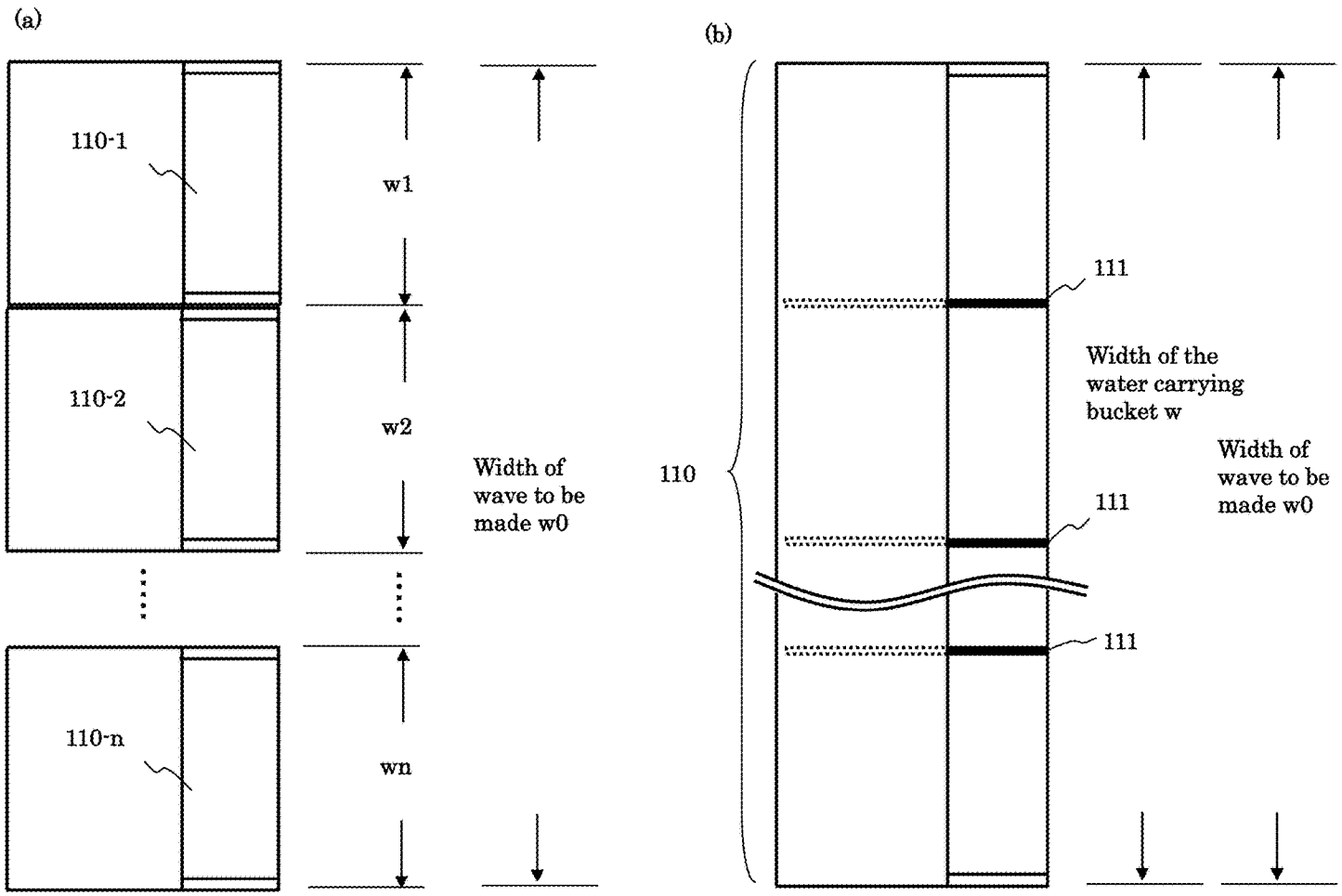
FIG. 9 (*a*) shows the case that has multiple pieces (n pieces) of the water carrying bucket 110.

FIG. 9 (*a*) shows the case that has multiple pieces (n pieces) of the water carrying bucket 110. The water carrying bucket 110-1 to **110-*n* arrayed in a line to the width direction faces its front surface to the play area. Each width is W1 to Wn. When all water carrying bucket 110-1 to 110-*n*** arrayed in a line move forward at the same time, the width W of the launched wave becomes as follows.

$$W=W1+W2+W3+\ldots+Wn$$

This W should be designed as the required width W0 of the waves launched to the play area.

FIG. 9 (*b*) shows the case which has singular of the water carrying bucket 110. If the width of the waves launched to the play area is required as W0, the width W of the water carrying bucket 110 may be designed as W=WO in this case.

As shown in FIG. 9 (*b*), it is preferable to provide single or plural partition panels 111 inside of the water carrying bucket 110 if W becomes larger than 10 meters. If there is the partition panel 111 provided at an appropriate distance, it is possible to adjust the entire traveling direction by adjusting each section of the traveling direction.

It is possible to restrain the turbulence to the horizontal direction, and form the high quality isolated travelling waves.

Next, the supporting structure body 120 is explained as below.

The supporting structure body 120 is a supporting structure to support entirely the water carrying bucket 110, the transmission apparatus 130 and so on. The width and length of the supporting structure body 120 should be determined appropriately to cover the width and the moving entire length of water carrying bucket 110.

However, it is necessary to design the supporting structure body 120 securing the mechanical strength to support the moving water carrying bucket 110, which moves forward rapidly while carrying the water in the inside space. And it is also possible to provide the side wall along the entire moving range that the water carrying bucket 110 as a part of the supporting structure body 120. FIG. 7 omits the side wall in order to show the inner structure clearly.

Next, the transmission apparatus 130 is explained as below.

This is the mechanism to move the water carrying bucket 110 forward along to the track lead to the front. The water carrying bucket 110 faces the play area and the lower part of the water carrying bucket 110 sinks under the water line of the pool. The water carrying bucket 110 is carried forward by the transmission apparatus 130.

There are plural types for the transmission apparatus 130.

Firstly, the cable type transmission apparatus is explained as below.

Figure 10:
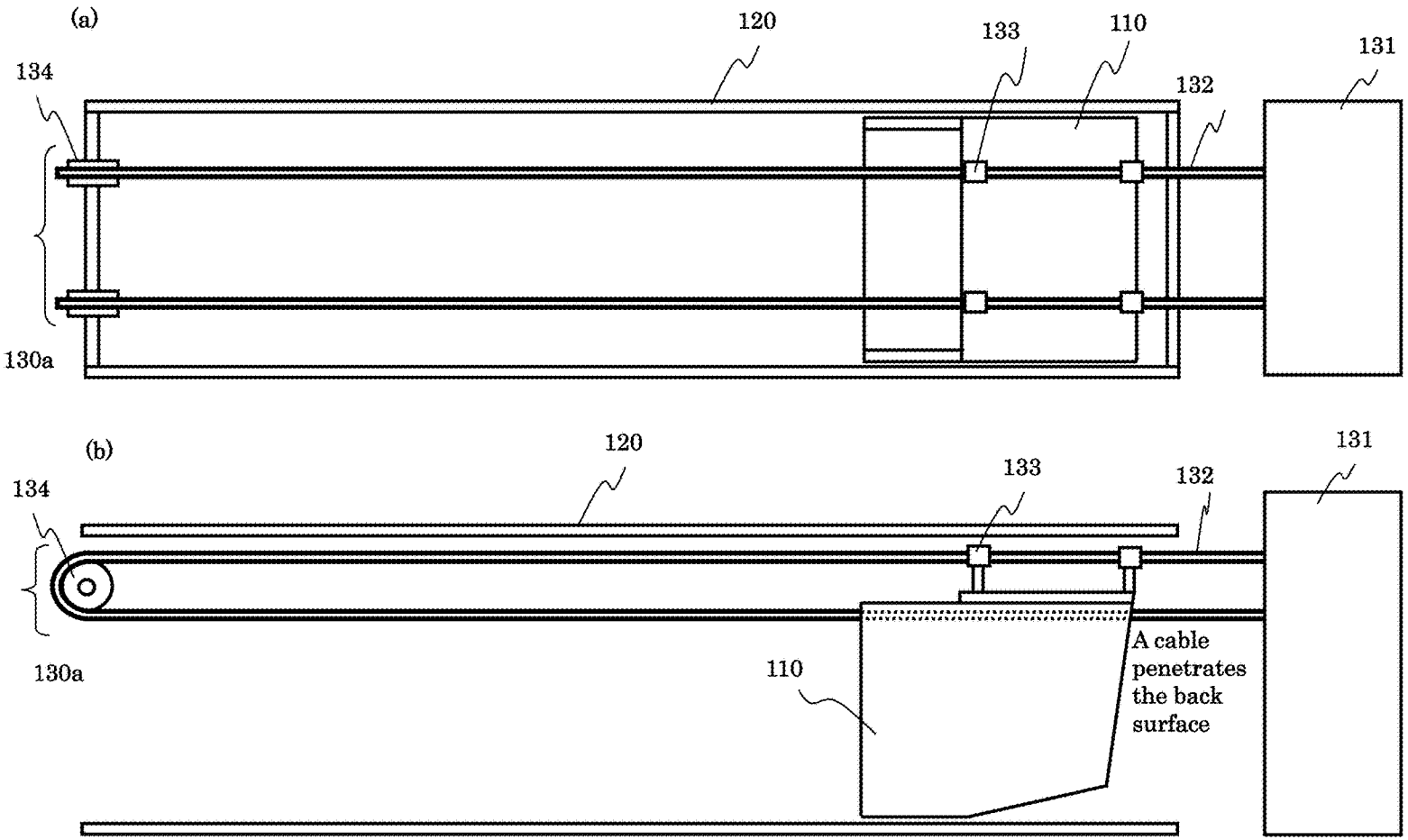
FIG. 10 (*a*) shows an example of cable type transmission apparatus 130*a* (plan view).

FIG. 10 shows an example of cable type transmission apparatus **130*a***.

A part of the supporting structure body 120 is further omitted from FIG. 10 compared with FIG. 7 in order to show the structure of cable type transmission apparatus **130*a***.

The cable type transmission apparatus **130*a* comprises a power unit 131, cable 132, connection parts 133 and the turning pulley 134 for turning the cable 132**.

This example includes the set of right-left systems of cable type transmission apparatus **130*a* for one water carrying bucket 110**.

The power unit 131 is the power source to give the pulling tensile force to the cables. In this example, the power unit 131 transmits the power to the cable 132 as the pulling tensile force to the wheel of the fixed pulley because the cable 132 is a circulate type.

The place to set the power unit 131 is not limited. In this example, the power unit 131 is set in the rear of the water carrying bucket 110 that stays at the opposite side of the play area of the pool.

If the power unit 131 is installed in the forward of the water carrying bucket 110 near to the play area side of the pool, the power unit 131 and the cable 132 are located in the pool surface, and it disturbs the surfing play because the power unit 131 and the cable 132 are placed near the surfing players. If the power section 131 is in the rear of water carrying bucket 110 at the opposite side of the play area of the pool and the turning pulley 134 mentioned as below faces to the play area, the cable 132 is not extended to the play area, so it doesn't disturb the surfing play of the surfing players.

The cable 132 is the tool to transmit tensile force to the water carrying bucket 110 by receiving the power from the power unit 131. The material is preferably a strong object such as a strong wire.

In this example, the cable 132 circulates in two stages of upper and lower turning in the turning pulley 134. There are upper line and the lower line.

In this configuration, the upper line is connected to the connection part 133 above the water carrying bucket 110 and the lower line penetrates the back surface of the water carrying bucket 110.

It is not essential that the lower line penetrates the back surface, however, the cable 132 penetrating the back surface adjusts the posture in order to prevent the water carrying bucket 110 from fluctuating vertically and horizontally.

The connection part 133 connects the water carrying bucket 110 and the cable 132 so the water carrying bucket 110 moves by following the movement of cable 132.

It is preferable that the arrangement of the connection part 133 is good balance because the pulling force is applied to the water carrying bucket 100 via the connection part 133. For example, the connection part 133 is installed as the equivalent portions to the right and left sides of the water carrying bucket 100. In addition, it is possible to provide plural of connection part 134 arrayed in the vertical direction.

The turning part 134 is the structure body installed between the water carrying bucket 110 and the play area to turn the cable back to the power unit side. For example, it is a fixed turning pulley to turn the direction of the cable from the forward direction to the backward direction. The installing position of the turning part 134 is just in front of the moving range of the water carrying bucket 110. It may be installed to a part of the support structure body 120.

In the cable type transmission apparatus 130*a* shown in FIG. 10, the cable 132 is pulled while circulating from the power unit 131—the connection part 133—the cable turning part 134—the power unit 131. Since the cable 132 circulates, the forward and backward movement of the water carrying bucket 110 can be executed reversibly.

Figure 11:
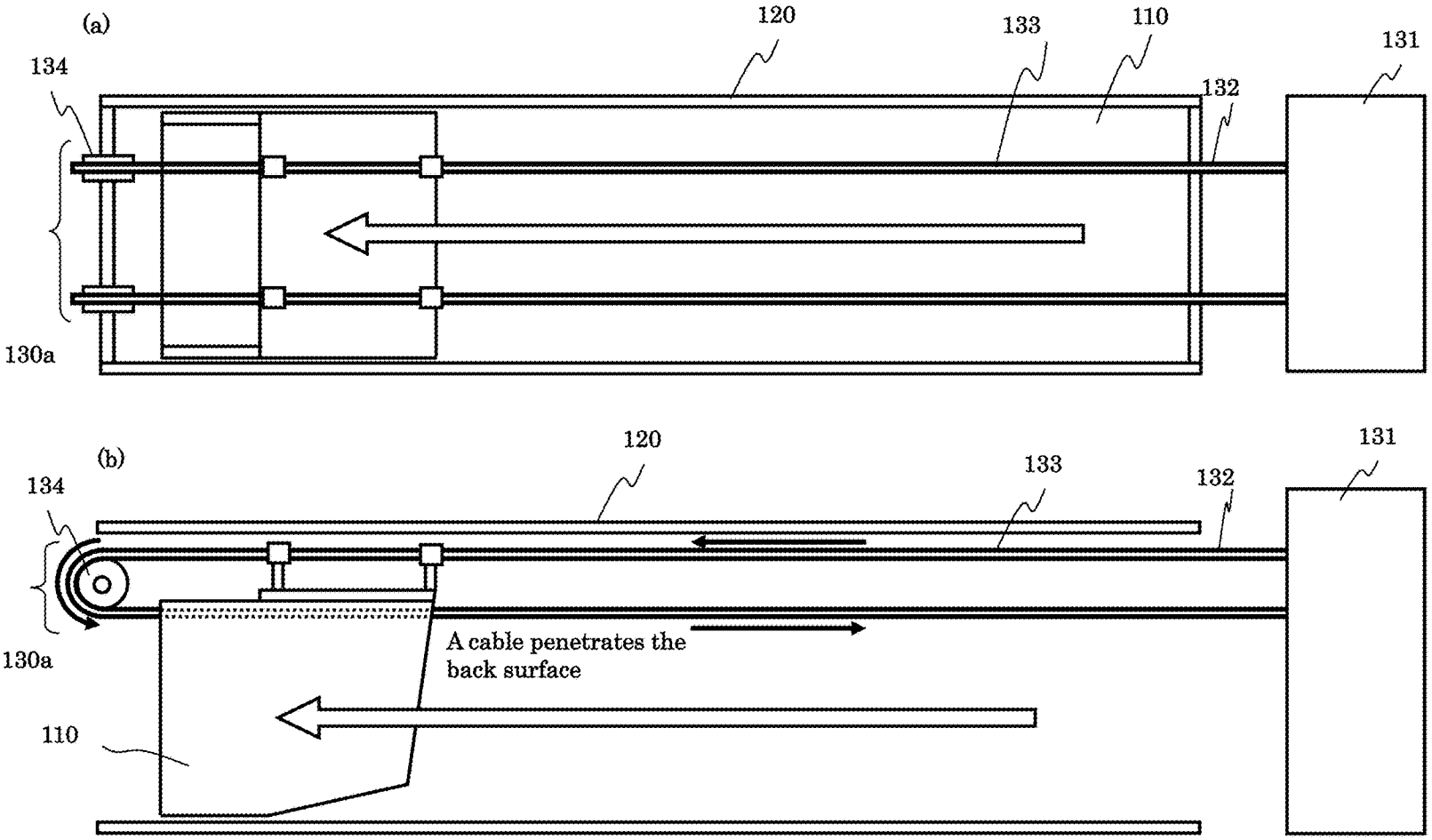
FIG. 11 (*a*) is a schematic view showing the moving of the water carrying bucket 110 forward by the cable type transmission apparatus 130*a* (plan view).

FIG. 11 is a schematic view showing the moving of the water carrying bucket 110 forward with the cable type transmission apparatus 130*a*. The power unit 131 rotates in normal direction and gives a power to the cable 132 for moving the water carrying bucket 110 forward. In this case, the lower line of the cable 132 penetrates the water carrying bucket 110, the movement of the lower line of the cable 132 (from left to right in the figure) and the water carrying bucket 110 (from right to left in the figure) become the opposite direction in this case.

Figure 12:
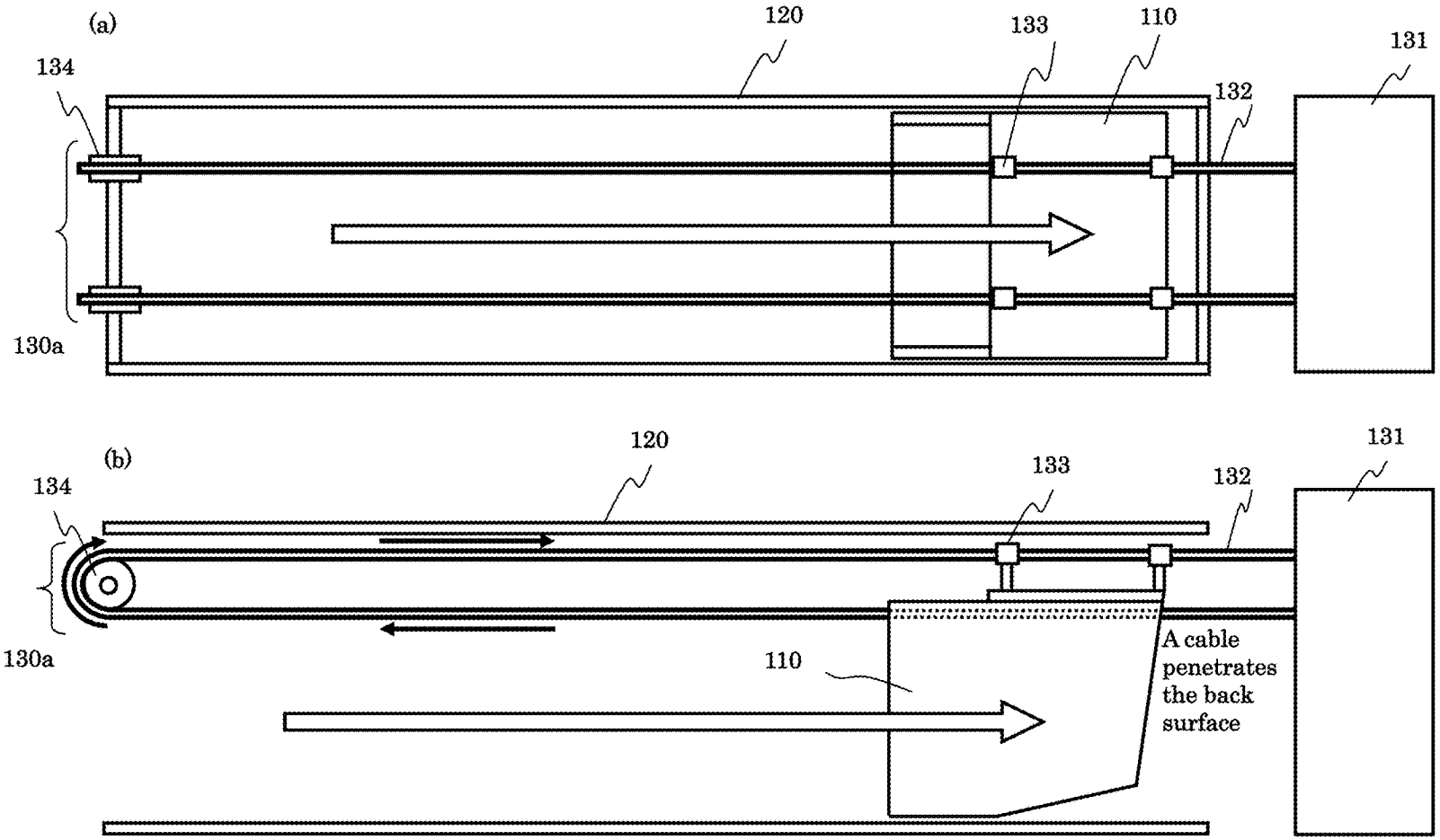
FIG. 12 (*a*) is a schematic view showing the moving of the water carrying bucket 110 backward by the cable type transmission apparatus 130*a* (plan view).

In contrast, FIG. 12 is a schematic view showing the moving of the water carrying bucket 110 backward with the cable type transmission apparatus 130*a*. The power unit 131 rotates in reverse direction and gives a power to the cable 132 for moving the water carrying bucket 110 backward. In this case, the movement of the lower line of the cable 132 (from right to left in the figure) and the water carrying bucket 110 (from left to right in the figure) become the opposite direction in this case.

As shown above, the forward and backward movement of the water carrying bucket 110 can be executed reversibly by switching the direction of the power given to the cable 132.

This example of the carry type wave making apparatus 100 doesn't extend to the play area of the pool, and therefore it does not disturb the activity the surfers.

Figure 13:
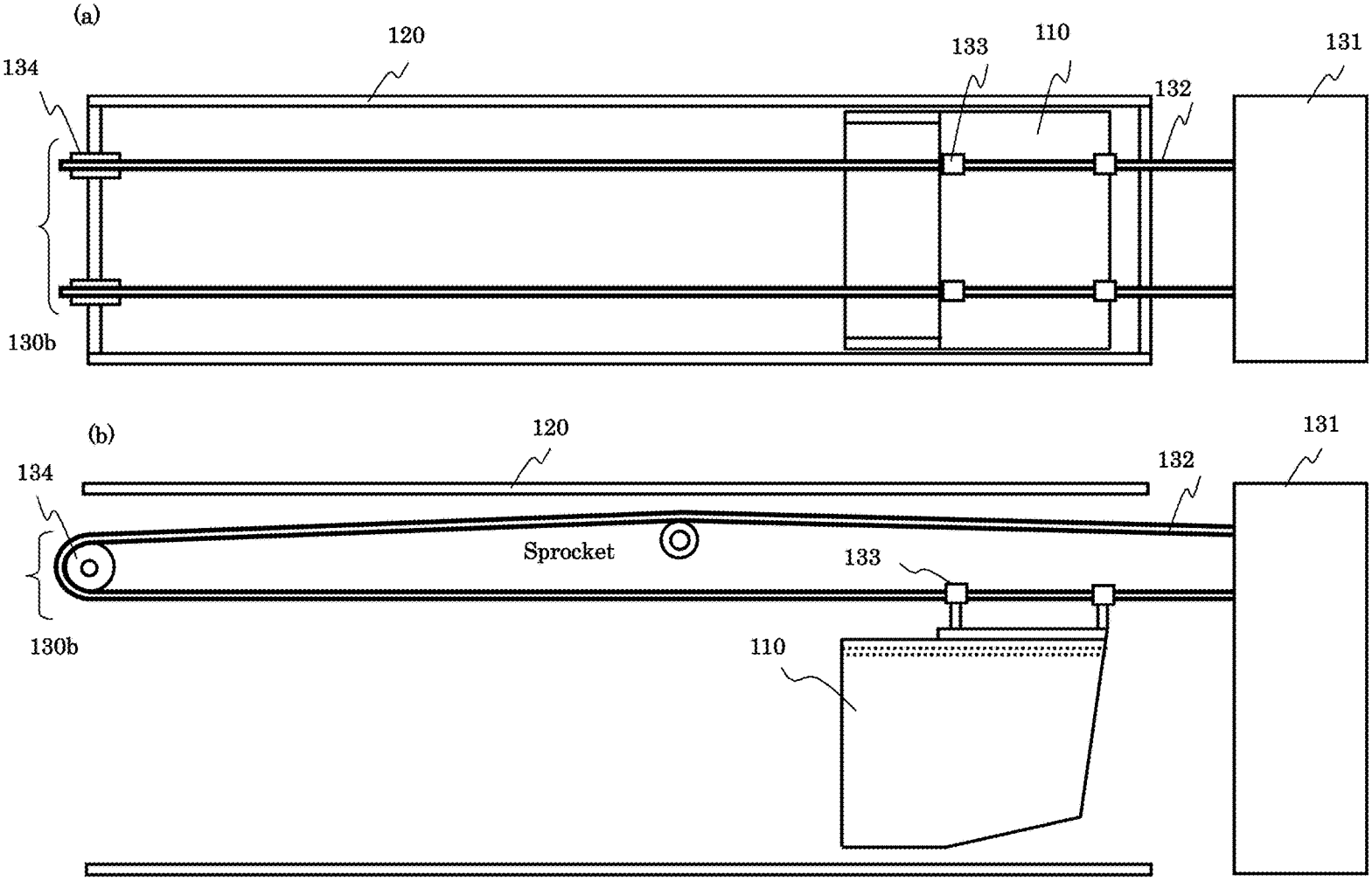
FIG. 13 (*a*) shows an example of cable type Transmission apparatus 130*b* (plan view).

Next, FIG. 13 shows an example of the cable type transmission apparatus 130*b* the same as the cable type transmission apparatus 130*a* shown in FIG. 9, but the structural arrangement is different. As shown in FIG. 13, the water carrying bucket 110 is fixed to the lower line of the cable 132 that is folded into two stages of upper and lower lines in this configuration.

The upper line of the cable 132 passes backward through a sprocket. The cable 132 circulates to the power unit 131—the cable turning part 134—connection part 133—power unit 131.

Figure 14:
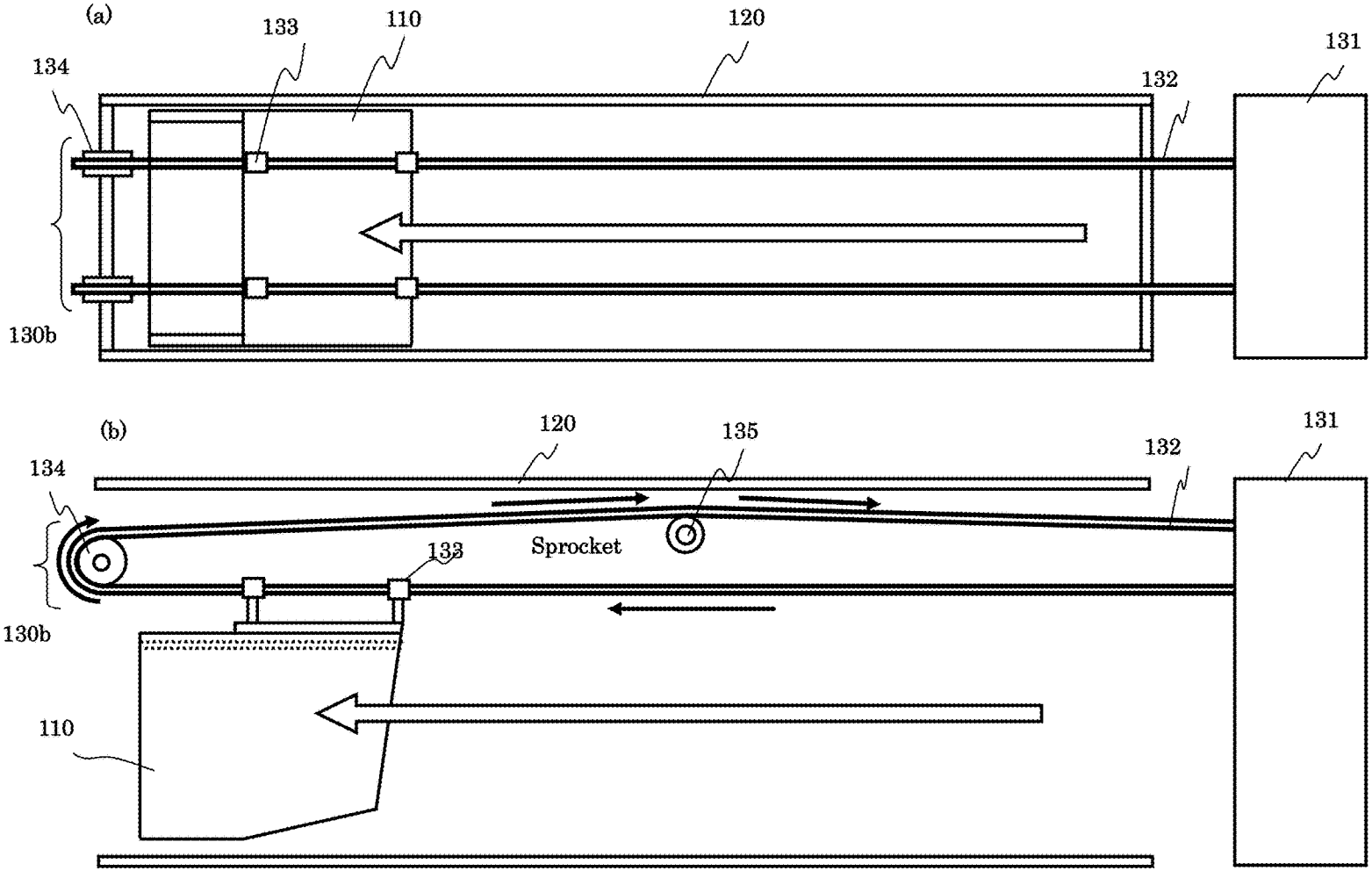
FIG. 14 (*a*) is a schematic view showing the moving forward of the water carrying bucket 110 by the cable type transmission apparatus 130*b* (plan view).

As shown in FIG. 14, the power unit 131 rotates in the normal direction and provides a power to the cable 132 for moving the water carrying bucket 110 forward. The lower line of the cable 132 and the water carrying bucket 110 move same direction. In this case, the movement of the lower line of the cable 132 (from right to left in the figure) and the water carrying bucket 110 (from right to left in the figure) become the same direction in this case.

Figure 15:
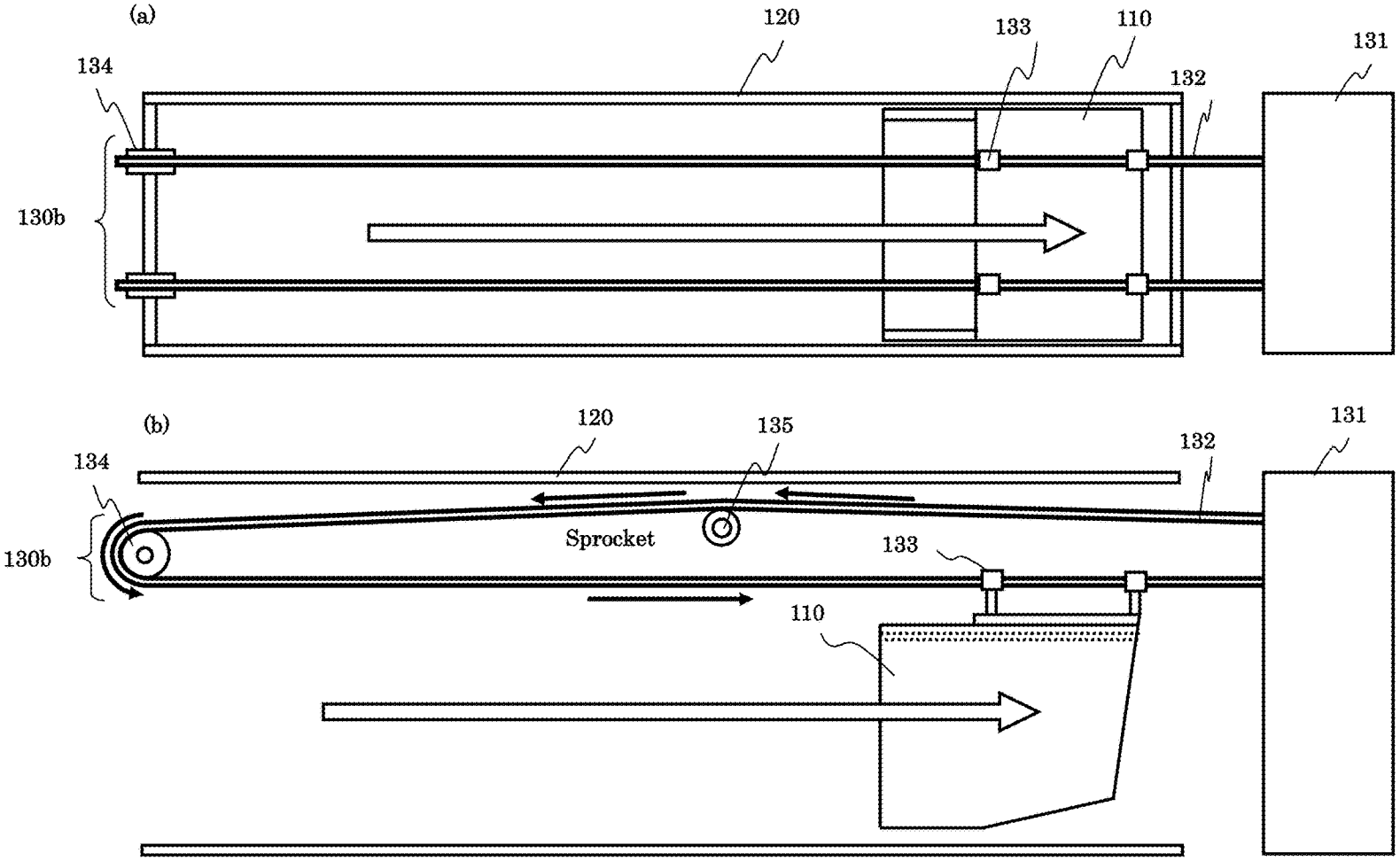
FIG. 15 (*a*) is a schematic view showing the moving backward of the water carrying bucket 110 by the cable type transmission apparatus 130*b* (plan view).

In contrast, as shown in FIG. 15, the power unit 131 rotates in reverse direction and provides a power to the cable 132 for moving the water carrying bucket 110 backward, the lower line of the cable 132 and the water carrying bucket 110 moves same direction. In this case, the movement of the lower line of the cable 132 (from left to right in the figure) and the water carrying bucket 110 (from left to right in the figure) become the same direction in this case.

As shown above, the forward and backward movement of the water carrying bucket 110 can be executed reversibly by switching the direction of the power supplied to the cable 132.

Next, the configuration including a guide rail in order to stabilize the movement of the water carrying bucket 110 by the transmission apparatus 130 is described.

The guide rail is employed for moving the water carrying bucket 110 along the precise track without swinging and vibration. Water carrying bucket 110 moves by applying the tensile force though the cable 132 in any structure of FIG. 10 or FIG. 13. The guide rail restrains the swing and vibration.

Figure 16:
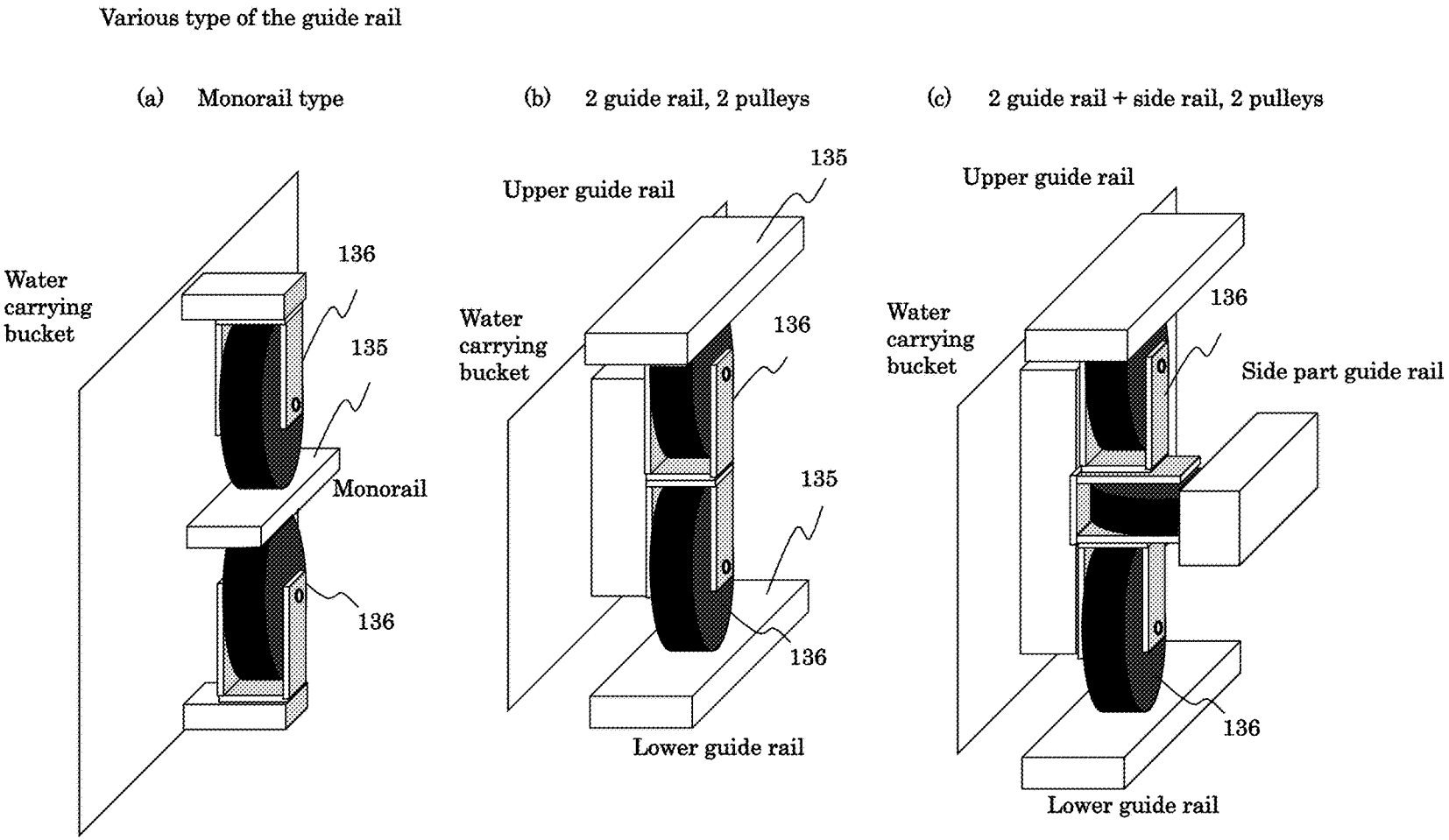
FIG. 16 (*a*) is a schematic view showing the guide rail 135 employed in the water carrying bucket 110 (monorail type).

FIG. 16 is a schematic view showing the guide rail 135 employed in the side of the water carrying bucket 110. FIG. 16 illustrates the area around the rail pulley 136 of the one side of the water carrying bucket 110 in order to facilitate understanding.

FIG. 16 (*a*) shows the monorail type structure in which there is one guide rail 135 pinched by the upper rail pulley 136 and the lower rail pulley 136. The rail pulley 136 is attached to the water carrying bucket 110 in the left side via the metal fittings, and the guide rail 135 is laid along the movement track which each rail pulley 136 should pass.

FIG. 16 (*b*) shows the structure in which there are a set of upper and lower guide rails 135, and set of upper and lower rail pulleys 136 inserted between the upper and lower guide rails 135. Each rail pulley 136 is attached to the water carrying bucket 110 in the left side via the metal fittings, and the guide rails 135 are laid along the movement track which each rail pulley 136 should pass.

FIG. 16 (*c*) shows the structure in which there are a set of upper and lower guide rails 135, and a set of upper and lower rail pulleys 136 inserted between the upper and lower guide rails 135. Furthermore the additional guide rail and rail pulley are installed at the side direction laid along the movement track that each rail pulley 136 should follow. In this configuration, the rail pulley 136 is guided in upper, lower and side directions, and the stability is improved.

Next, it is possible that different types can be employed as the transmission apparatus.

The motor drive type transmission apparatus 130*c* is explained as below.

Figure 17:
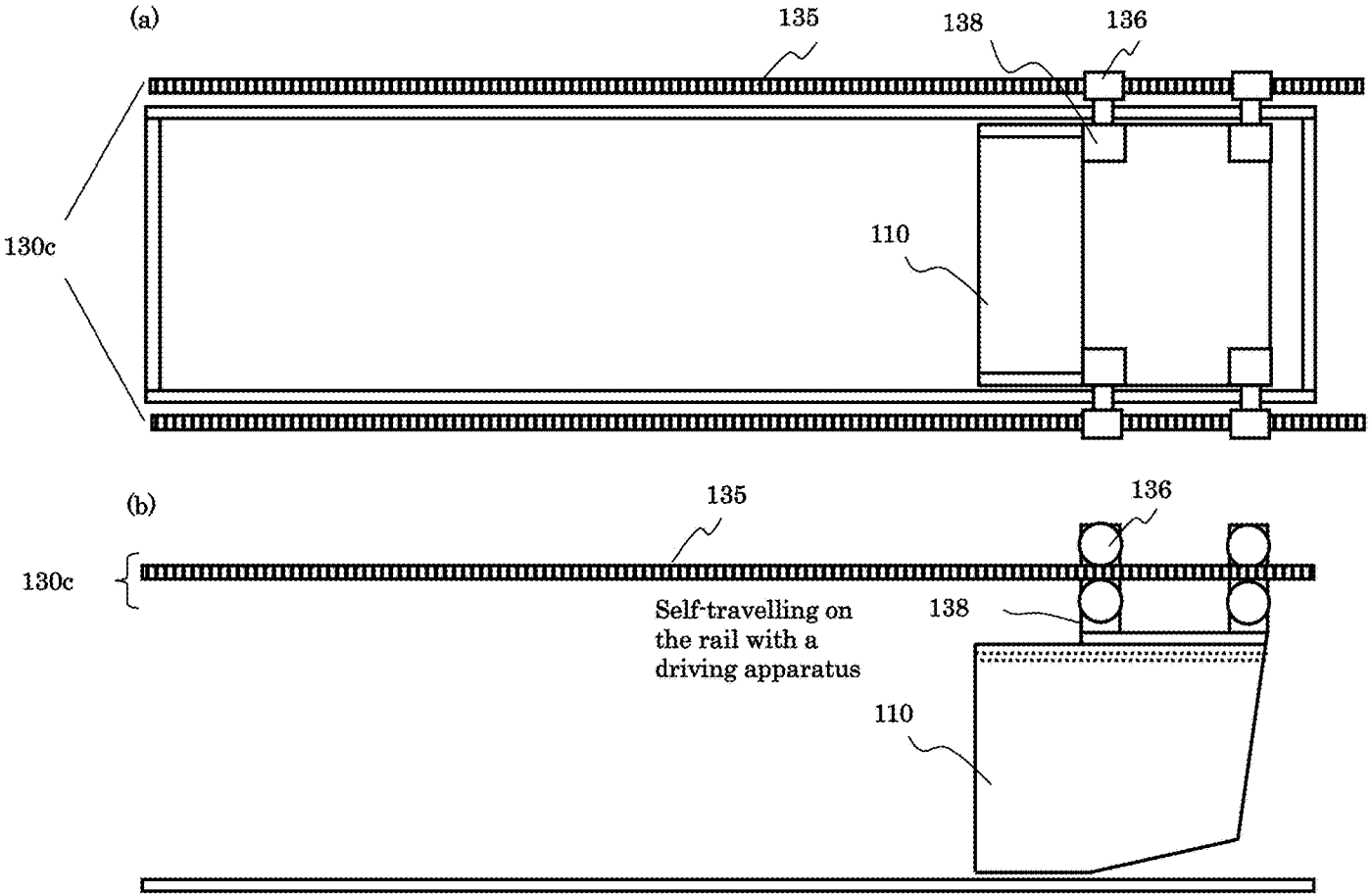
FIG. 17 (*a*) shows an example of the motor drive unit type transmission apparatus 130*c* (plan view).

FIG. 17 shows an example of the motor drive type Transmission apparatus 130*c*.

The motor drive type transmission apparatus 130*c* shown in FIG. 17 comprises a guide rail 135, a driving unit 138 and a connection part 139. It is different from the cable type transmission, the water carrying bucket 110 having the motor drive unit 138 can perform self-running.

The guide rail 135 gives the track of the water carrying bucket 110. It is provided in the pool side in this configuration.

The driving unit 138 is provided between the guide rail 135 and the water carrying bucket 110 and supplies driving force to the water carrying bucket 110. In this example, the driving unit 138 is provided as a motor drive unit with wheels to self-run on the guide rail 135. In this example, the driving unit 138 has two wheels and configures a so-called monorail type driving apparatus, in which each wheel catches the top surface and under surface of the guide rails.

The connection part 139 connects the driving apparatus 138 and the water carrying bucket 100. The water carrying bucket 110 is driven by the driving unit 138 via the connection part 139.

Figure 18:
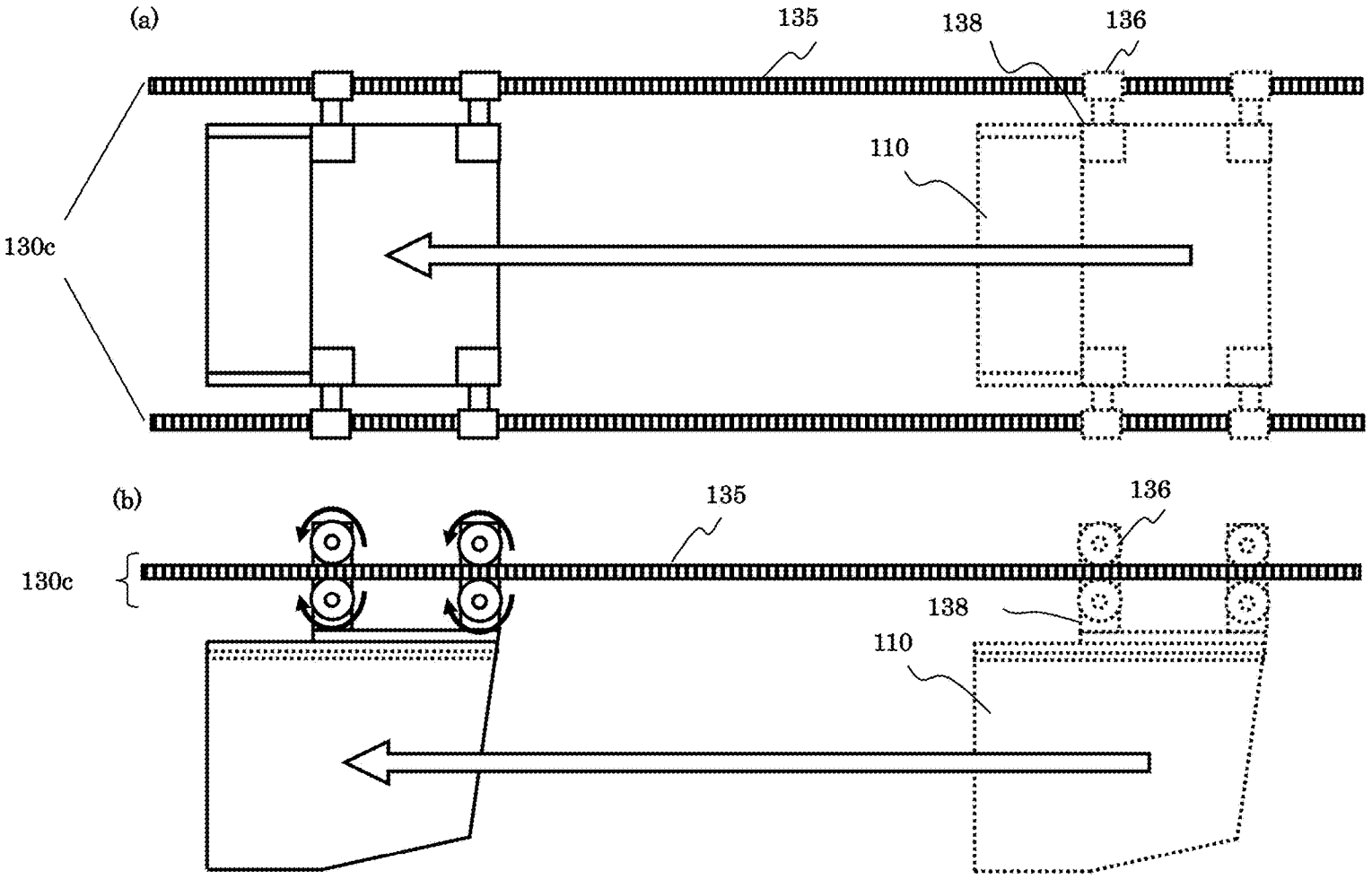
FIG. 18 (*a*) is a schematic view showing the moving forward of the water carrying bucket by the drive unit 138 on the guide rail 135 in the normal rotation (plan view).

FIG. 18 is a schematic view showing the moving forward of the water carrying bucket 110 by the drive unit 138 on the guide rail 135 in the normal rotation.

Figure 19:
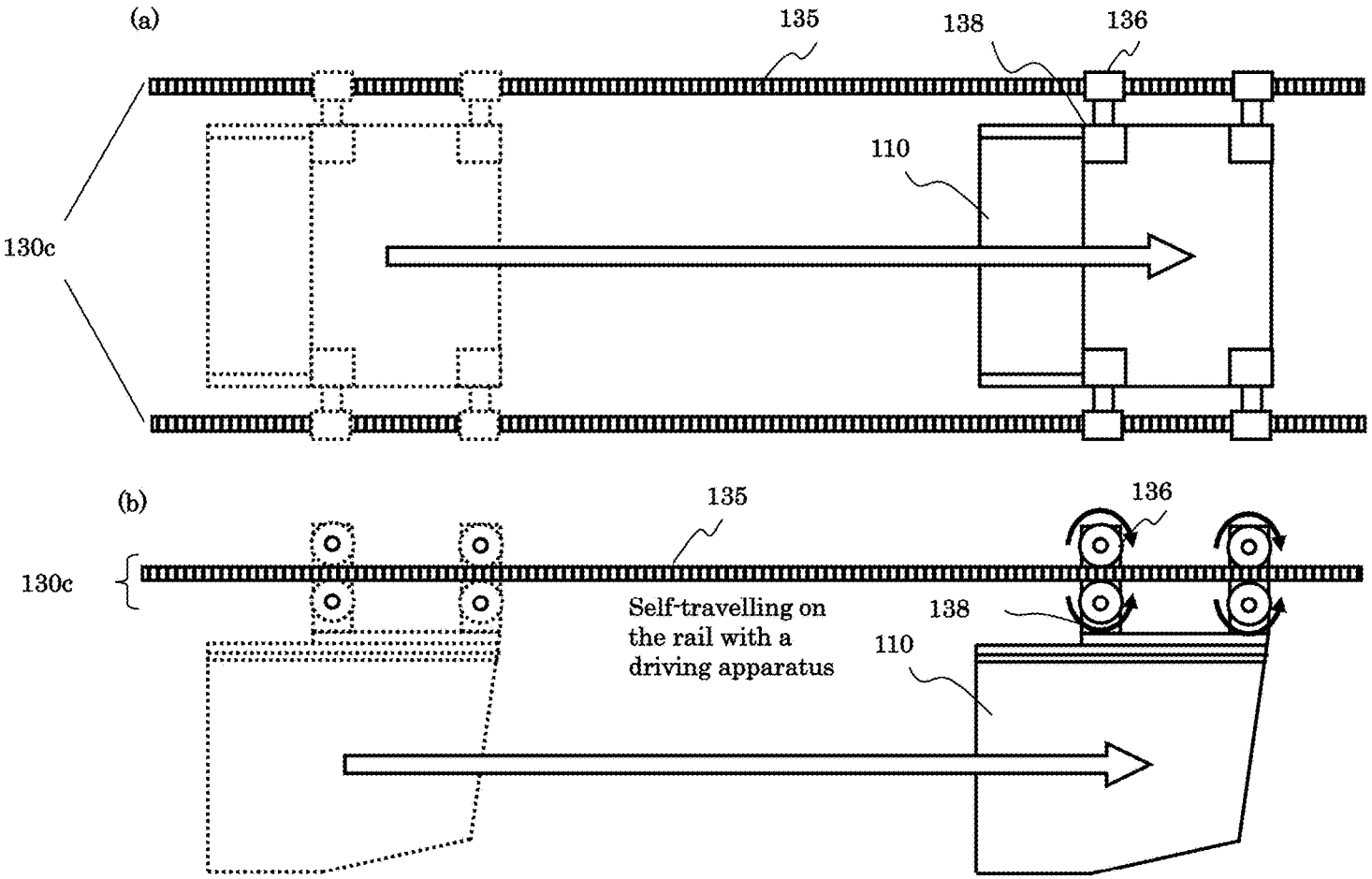
FIG. 19 (*a*) is a schematic view showing the moving backward of the water carrying bucket by the drive unit 138 on the guide rail 135 in the reverse rotation (plan view).

In contrast, FIG. 19 is a schematic view showing the moving backward of the water carrying bucket 110 by the drive unit 138 on the guide rail 135 in the reverse rotation.

As shown above, turning the forward movement and backward movement of water carrying bucket 110 can be done by switching the driving direction of driving unit 138.

Another type is possible for the transmission apparatus. For example, the pushing out type transmission apparatus is possible. It includes a pushing out axis that can extend rapidly to move the water carrying bucket 110 by pushing the back surface of the water carrying bucket 100.

This is the basic structure of the wave making apparatus for surfing 100.

Next, the training equipment for surfing including pool 200 of this invention is mentioned as below.

As mentioned above, the isolated travelling waves are formed by the above wave making apparatus for surfing of the present invention and the formed isolated travelling waves reach the play area of the pool. There is a device in the bottom of the pool 200 to form so-called tubular curling waves suitable for surfing by emerging a wave breaking area followed by a wave about to break area in a line in the isolated waves.

Figure 20:
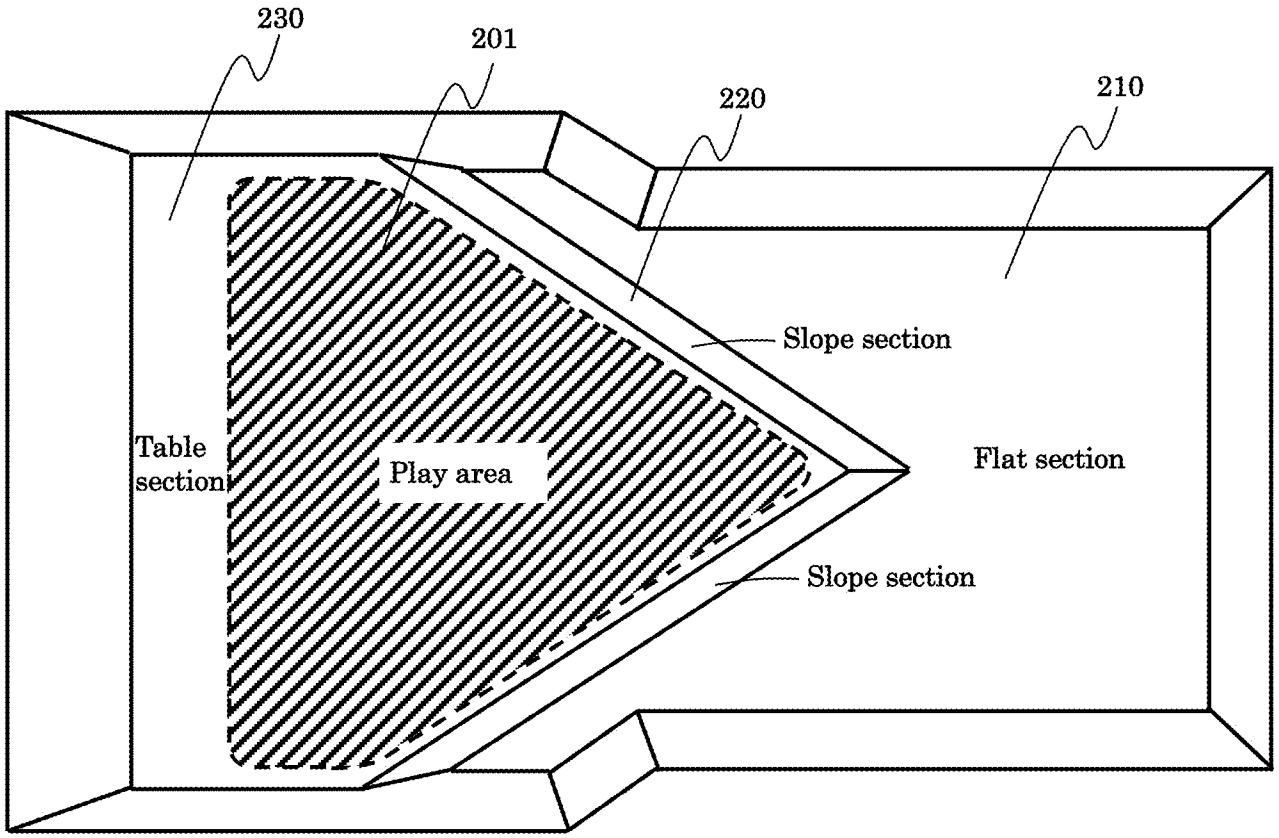
FIG. 20 is a schematic view showing the bottom of pool 200 employed in the training equipment for surfing of this invention in order to understand easily.

FIG. 20 is a schematic view showing the bottom of pool 200 employed in the training equipment of surfing of this invention. FIG. 20 shows the plan view.

As shown in FIG. 20, the bottom of the pool 200 comprises a flat portion 210, a slop portion 220 and a table portion 230. There is a play area 201 in the center portion of the pool 200.

The flat portion 210 is the flat portion which is succeeding part from the movement range of the water carrying bucket 110. The flat portion 210 is located in front of the wave making apparatus. The water depth of the pool in the flat portion 210 is relatively larger than that of the play area.

The slope portion 220 is an ascending slope provided in the vicinity of the start of the play area 201, and the slope portion 220 follows from the flat section 210. The water depth is gradually getting shallow by passing through this slope portion 220.

The slope portion 220 is not provided perpendicular to the traveling direction of the traveling wave but provided with certain angle. In other words, the slope section 220 has a skew with a certain angle relative to the traveling direction of the water carrying bucket 110. The example shown in FIG. 20 is approximately triangle shape. If the slope section 220 has a skew with a certain angle to the traveling direction, there is delay in the timing to reach the slope portion 220. The wave portion that reaches the slope portion 220 first has started to pass the area gradually getting shallow. The wave portion next to the first portion reaches to the slope portion 220 and has started to pass the area gradually getting shallow. Furthermore, the following wave portion reaches to the slope portion 220 and has started to pass the area gradually getting shallow. In this manner, the water depth change has started from one after another in order.

The table portion 230 is the stage shape part that is shallow and follows the slope section 220. There is a play area 201 in this table portion 230. The far side of table portion 230 becomes close to the end of the pool, and the play area 201 can be set appropriately.

The reason why the tubular curling waves are easily formed can be explained as below.

The speed of waves is affected by the depth of water in the pool. It is known the speed of the wave becomes faster according to an increased depth of the water, and the speed of the wave becomes slower according to the depth of the water being shallower. Therefore the speed slows as the depth becomes shallow according to the slope portion 220 ascending up from the flat portion 210. When passing through the slope portion 220, the difference of the speed in the front edge of the wave and the following back portion grows, and finally, the back portion of the wave get ahead of and rides on the front edge of the wave, then a so-called tubular curling wave is formed, and the front edge starts to break downward in front of the curling wave.

In this example, as the slope portion 220 is a triangle shape having a vertex, the traveling wave portion corresponding to the vertex position has started to slow its speed, then the portion next to the vertex position has started to slow its speed one after another in order along the triangle side. The first portion where the wave breaking portion is formed corresponds to the vertex position. The wave breaking portion emerges one after another in order toward the side direction in the traveling wave, and then a so-called tubular curling wave is formed. In this example, the tubular curling wave is formed to the right and to the left from the break position that corresponds to the vertex position.

Figure 21:
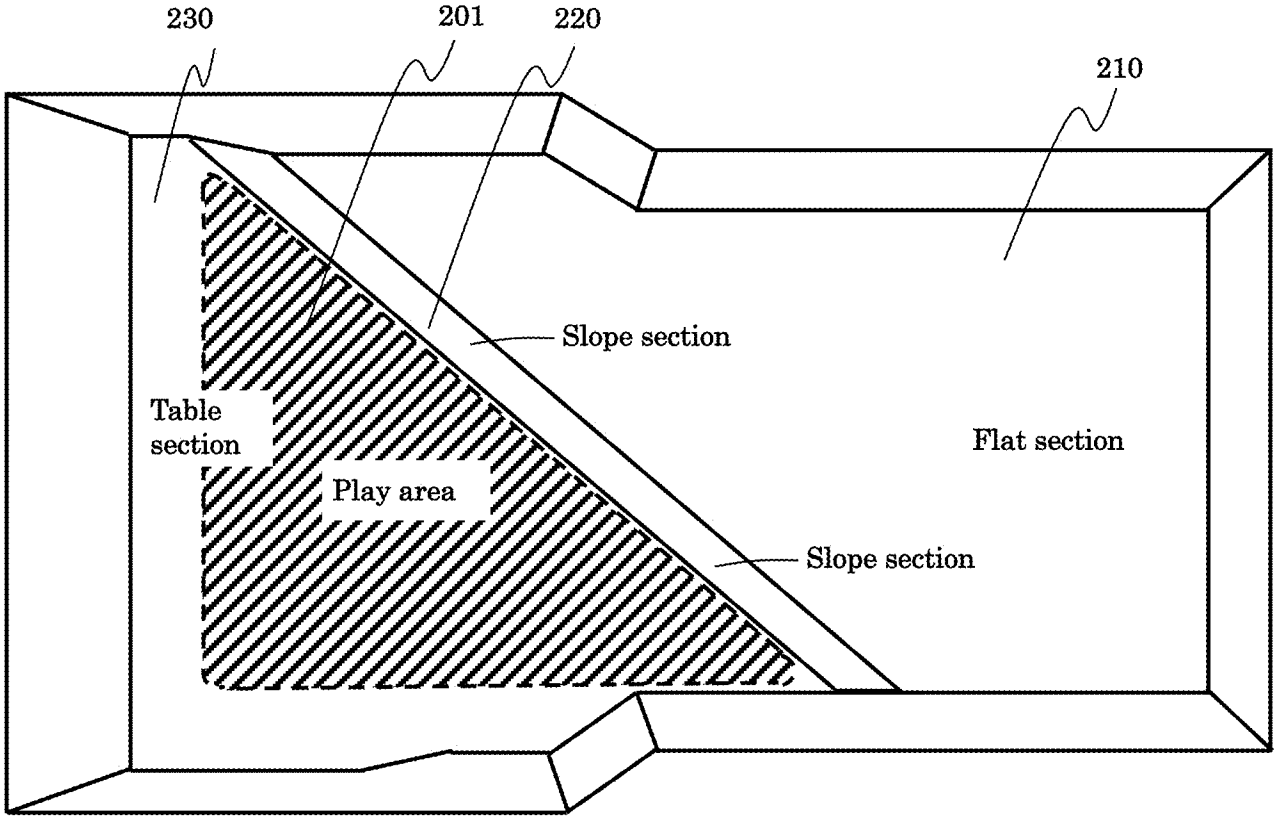
FIG. 21 is a schematic view of the example employing the slope section 220 that runs diagonally.

The shape of the slope portion 220 has various types in which there is an angle relative to the traveling waves. FIG. 21 is a schematic view of the example employing the slope section 220 that crosses the pool diagonally. In this example, one curling wave from one side to the other side of the pool will be formed.

Figure 22:
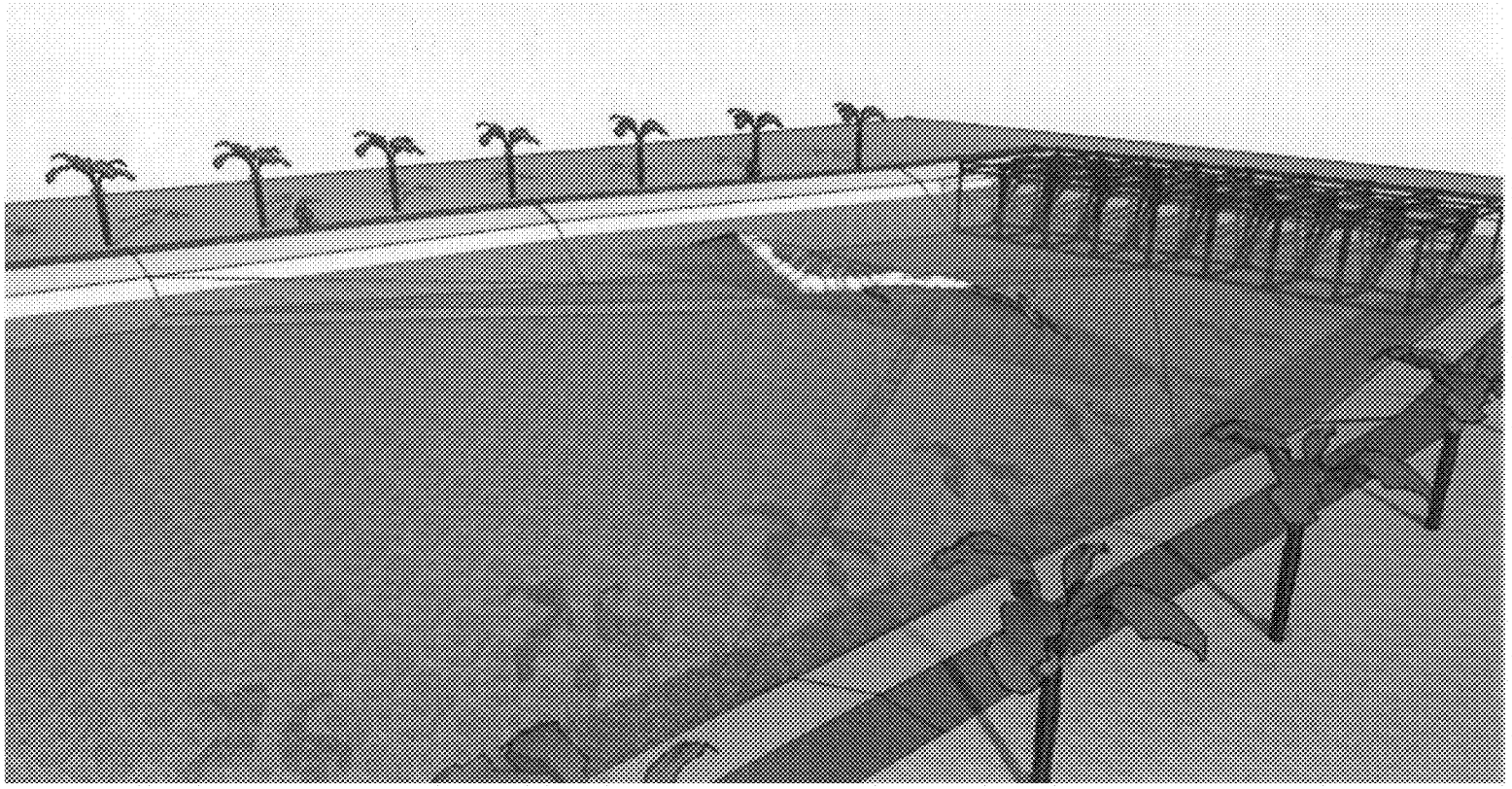
FIG. 22 shows the entire image of the training equipment for surfing comprising the wave making apparatus for surfing 100 and the pool 200 of the present invention (Part 1)
Figure 23:
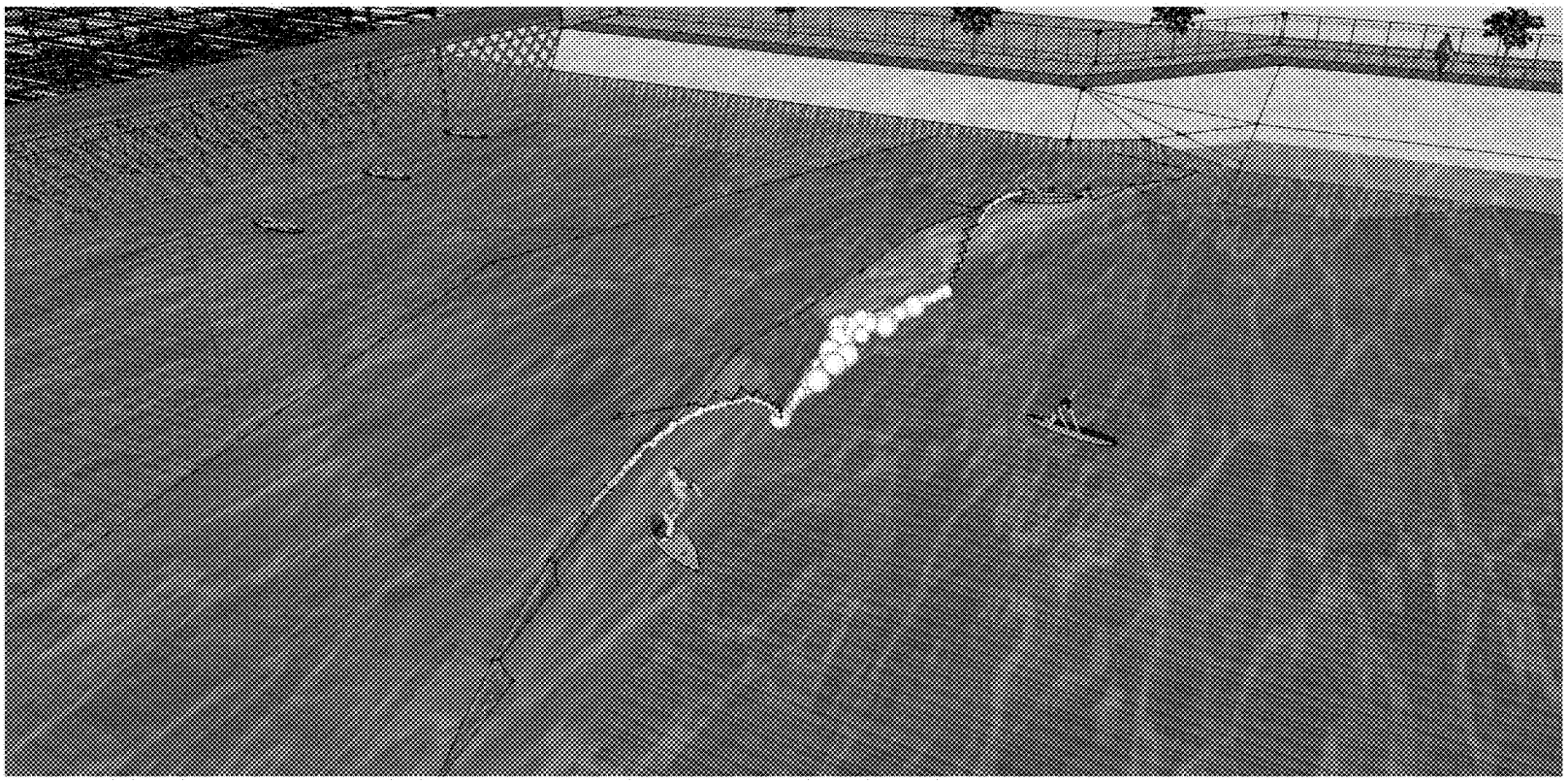
FIG. 23 shows the entire image of the training equipment for surfing comprising the wave making apparatus for surfing 100 and the pool 200 of the present invention (Part 2)
Figure 24:
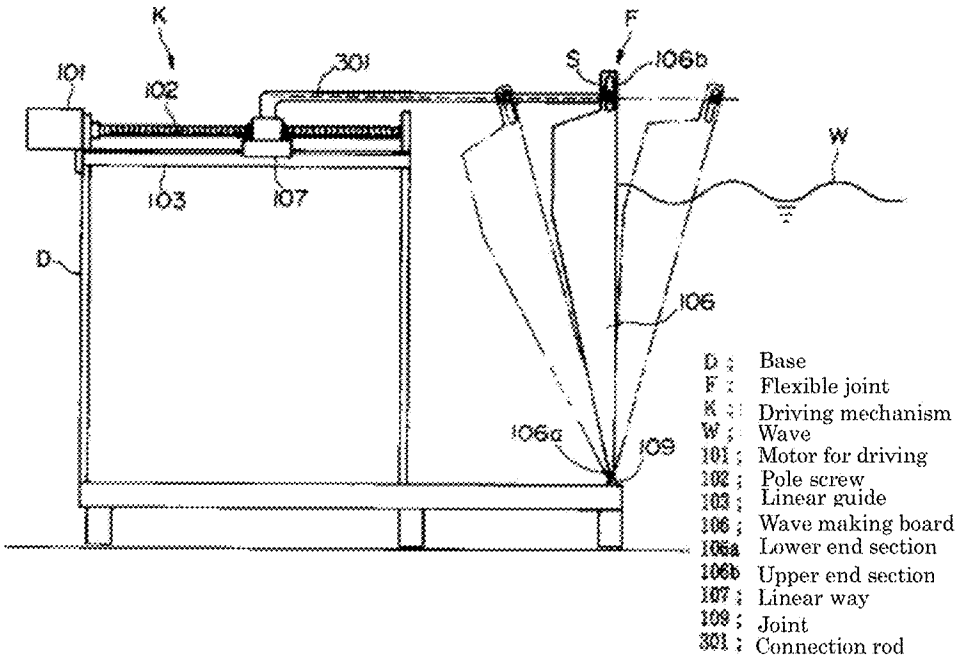
FIG. 24 is a schematic view of the configuration of the flap type wave making apparatus in the prior art.
Figure 25:
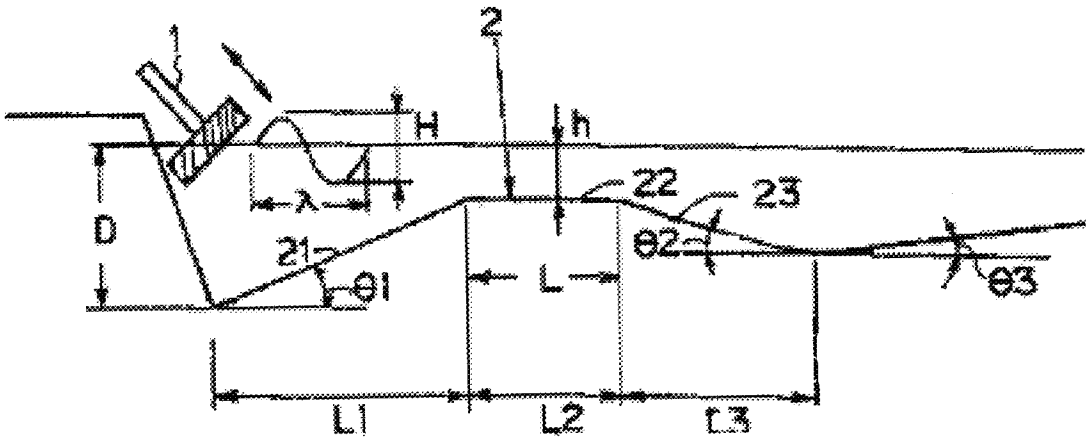
FIG. 25 is a schematic view of the configuration of the piston type wave making apparatus in the prior art.
Figure 26:
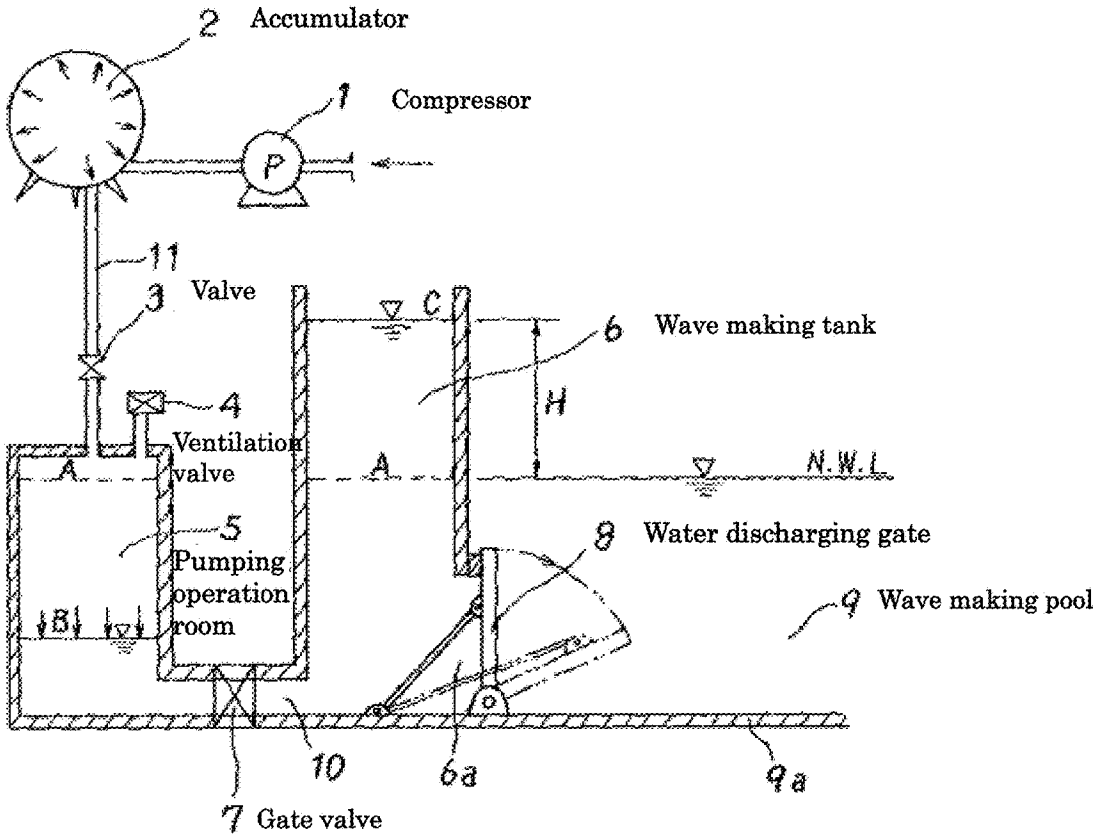
FIG. 26 is a schematic view of the configuration of the air compression type wave making apparatus in the prior art.
Figure 27:
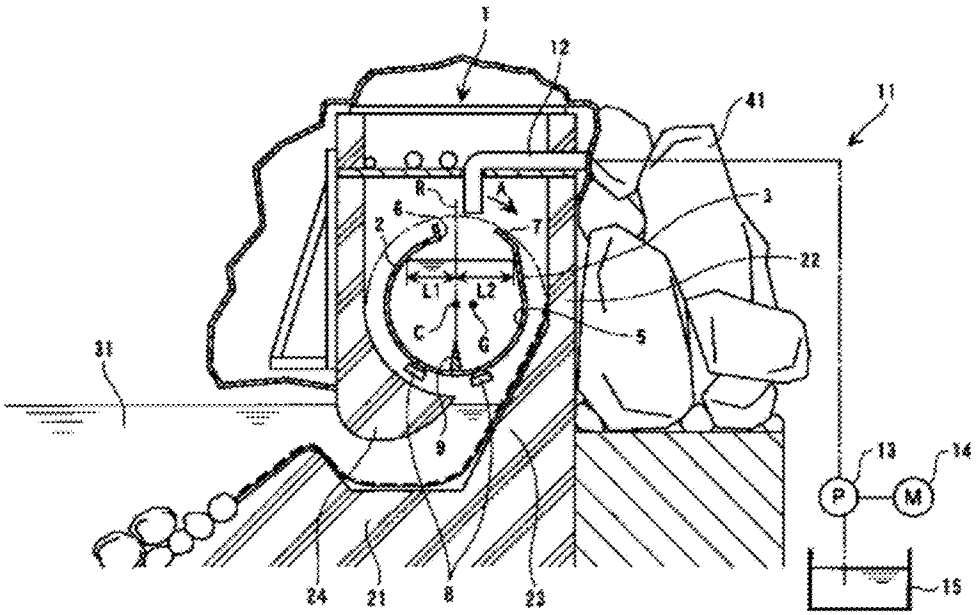
FIG. 27 is a schematic view of the configuration of the tank chamber type wave making apparatus in the prior art.
Figure 28:
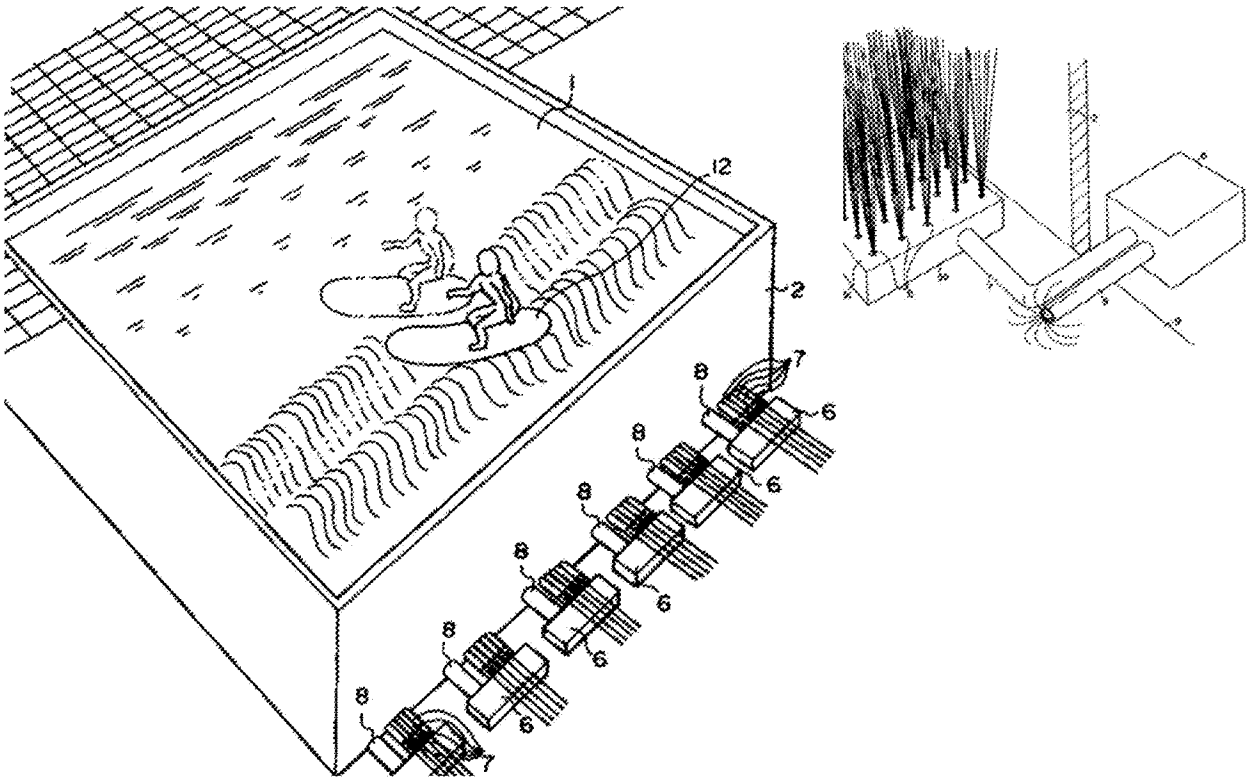
FIG. 28 is a schematic view of the configuration of the water jet nozzle type wave making apparatus in the prior art.

Finally, the image of the entire of the training equipment for surfing employing the wave making apparatus for surfing 100 of this invention and pool 200 are shown to FIG. 22 and FIG. 23.

In this example, 4 sets of the wave making apparatus for surfing 100 of this invention are lined up from right to left. The width of the play area is rather wide to properly enjoy surfing, and it is necessary that the length of the tubular curling waves shall be some extent long. Therefore, it is preferable that plural sets of wave making apparatus for surfing 100 arrayed in a line.

While some preferable embodiments of the sample storage according to the present invention are described above, it should be understood that various changes are possible, without deviating from the technical scope according to the present invention. Therefore, the technical scope according to the present invention is limited only by the claims attached.

INDUSTRIAL APPLICABILITY

A wave making apparatus according to the present invention can be employed in the wave making apparatus for surfing installed to the in-door recreation and the out-door recreation.

DESCRIPTION OF THE REFERENCE NUMERALS

100 Wave making apparatus for surfing
110 Water carrying bucket

120 Supporting structure body
121 Side wall
130 Transmission apparatus
131 Driving unit
132 Cable
133 Connection part
134 Turning part
135 Guide rail
136 Pulley
138 Driving unit
139 connection part

The invention claimed is:

1. A wave making apparatus for making a wave for surfing travelling forward to a play area in a pool, comprising;

a water carrying bucket comprising a bottom plate, right side plate and left side plates whose front is opened and that can hold water in a part of an inner space while carrying water forward;

a supporting structure supporting the water carrying bucket in a part-submerged state under waterline of the pool and facing with its front to the play area of the pool;

a transmission apparatus to transmit the water carrying bucket forward along to a track toward the play area as the water carrying bucket in the part-submerged state under waterline of the pool and facing with its front to the play area of the pool;

wherein the carried water carried by the water carrying bucket transmitted by the transmission apparatus is launched forward to generate a wave.

2. The wave making apparatus according to claim 1, in which there are plural water carrying buckets supported arrayed in a line in the width direction facing the play area.

3. The wave making apparatus according to claim 1, in which there is single water carrying bucket having a width corresponding to the width of the wave to be generated, wherein the water carrying bucket comprises one or plural partition plates installed back and forth direction in vertical in the water carrying bucket.

4. The wave making apparatus according to claim 1, wherein the transmission apparatus is a cable type transmission apparatus comprising a power unit; a cable moved by the power of the power unit; and a connection part for connecting the water carrying bucket and the cable for transmitting the water carrying bucket according to the cable motion.

5. The wave making apparatus according to claim 4, in which the power unit is installed at the back portion of the water carrying bucket in an initially set position; and there is a fixed turning pulley for turning the cable from forward to backward; wherein the cable is wired in a circuit from the power unit—the connection part—the fixed turning pulley—back to the power unit; wherein the water carrying bucket can be operated going forward and going backward repeatedly by the power unit.

6. The wave making apparatus according to claim 4, in which the power unit is installed at the back portion of the water carrying bucket in an initially set position; and there is a fixed turning pulley for turning the cable from forward to backward; wherein the cable is wired in a circuit from the power unit—the fixed turning pulley—the connection part—back to the power unit; wherein the water carrying bucket can be operated going forward and going backward repeatedly by the power unit.

7. The wave making apparatus according to claim 4, wherein there are plural systems of the transmission apparatuses per one water carrying bucket and there are plural connection parts corresponding to plural systems of the transmission apparatuses; and the water carrying bucket is operated according to the cables of the plural systems of the transmission apparatuses.

8. The wave making apparatus according to claim 4, wherein the transmission apparatus further comprises a guide rail installed along to the track for the water carrying bucket running through; and a guide wheel running on the guide rail; and the guide wheel is installed on the water carrying bucket.

9. The wave making apparatus according to claim 1, wherein the transmission apparatus is a drive unit type transmission apparatus comprising a guide rail installed along to the track for the water carrying bucket running through; and a drive unit is installed between the guide rail and the water carrying bucket; wherein the drive unit provides moving power to the water carrying bucket.

10. The wave making apparatus according to claim 1, further comprising a partition side wall in the pool along to the whole range where the water carrying bucket runs.

11. A surfing training equipment comprising;

a wave making apparatus according to claim 1;

a pool;

in which the bottom structure of pool comprises a flat base portion extending from the water carrying bucket moving range to the beginning of a play area; an ascending slope portion extending from the end of the flat base portion to the play area;

wherein the ascending slope portion has a skew relative to the water carrying bucket running direction.

12. The surfing training equipment according to claim 11, wherein the ascending slope portion is a triangle shape whose vertex faces the water carrying bucket running direction.

* * * * *